United States Patent [19]

Vrzalik

[11] Patent Number: 5,044,029

[45] Date of Patent: Sep. 3, 1991

[54] ALTERNATING PRESSURE LOW AIR LOSS BED

[75] Inventor: John H. Vrzalik, San Antonio, Tex.

[73] Assignee: Kinetic Concepts, Inc., San Antonio, Tex.

[21] Appl. No.: 512,570

[22] Filed: Apr. 9, 1990

Related U.S. Application Data

[63] Continuation of Ser. No. 181,922, Apr. 15, 1988, abandoned, which is a continuation-in-part of Ser. No. 57,965, Jun. 1, 1987, abandoned, which is a continuation-in-part of Ser. No. 905,553, Sep. 9, 1986, abandoned, which is a continuation-in-part of Ser. No. 784,875, Oct. 4, 1985, abandoned, which is a continuation-in-part of Ser. No. 683,153, Dec. 17, 1984, abandoned.

[51] Int. Cl.[5] ..... A61G 7/06

[52] U.S. Cl. ..... 5/453; 5/455

[58] Field of Search ..... 5/61, 423, 449, 453–458, 5/469; 128/33

[56] References Cited

U.S. PATENT DOCUMENTS

| | | | |
|---|---|---|---|
| 2,998,817 | 9/1961 | Armstrong . | |
| 3,340,550 | 9/1967 | Hopkins et al. . | |
| 3,340,551 | 9/1967 | Hopkins . | |
| 3,390,674 | 7/1968 | Jones . | |
| 3,467,081 | 9/1969 | Glass . | |
| 3,477,071 | 11/1969 | Emerson . | |
| 3,485,240 | 12/1969 | Fountain . | |
| 3,493,988 | 2/1970 | De Mare . | |
| 3,587,568 | 6/1971 | Thomas . | |
| 3,653,083 | 4/1972 | Lapidus . | |
| 3,678,520 | 7/1972 | Evans . | |
| 3,775,781 | 12/1973 | Bruno et al. . | |
| 3,822,425 | 7/1974 | Scales | 5/469 X |
| 3,935,604 | 2/1976 | Collins | 5/455 X |
| 4,193,149 | 3/1980 | Welch | 5/453 X |
| 4,225,989 | 10/1980 | Corbett et al. . | |
| 4,391,009 | 7/1983 | Schild et al. . | |
| 4,483,030 | 11/1984 | Flick et al. . | |
| 4,525,885 | 7/1984 | Hunt et al. . | |
| 4,542,547 | 9/1985 | Sato . | |
| 4,638,519 | 1/1987 | Hess | 5/453 X |
| 4,686,722 | 8/1987 | Swart . | |
| 4,694,520 | 9/1987 | Paul et al. . | |
| 4,745,647 | 5/1988 | Goodwin . | |
| 4,768,249 | 9/1988 | Goodwin | 5/453 |
| 4,797,962 | 1/1989 | Goode . | |
| 4,803,744 | 2/1989 | Peck et al. . | |

FOREIGN PATENT DOCUMENTS

| | | | |
|---|---|---|---|
| 0168213 | 1/1986 | European Pat. Off. . | |
| 0228233 | 7/1987 | European Pat. Off. . | |
| 2816642 | 10/1973 | Fed. Rep. of Germany . | |
| 3217981 | 11/1982 | Fed. Rep. of Germany . | |
| 946831 | 1/1964 | United Kingdom | 5/455 |
| 959103 | 5/1964 | United Kingdom . | |
| 1273342 | 5/1972 | United Kingdom . | |
| 1341325 | 12/1973 | United Kingdom . | |
| 1474018 | 5/1977 | United Kingdom . | |
| 1483045 | 8/1977 | United Kingdom . | |
| 1545806 | 5/1979 | United Kingdom . | |
| 1576641 | 10/1980 | United Kingdom | 5/453 |
| 2090734 | 7/1981 | United Kingdom | 5/455 |
| 2141333 | 12/1984 | United Kingdom . | |

*Primary Examiner*—Michael F. Trettel
*Attorney, Agent, or Firm*—Cox & Smith Incorporated

[57] ABSTRACT

A method and apparatus for therapeutically treating immobile patients is disclosed. A low air loss bed is provided having groups of transversely oriented air bags, each group corresponding to a different portion of the body of a patent supported thereon. Each group comprises first and second sets of air bags alternately positioned in an interdigitated fashion. Valves and circuitry are provided for maintaining a selectable baseline pressure in the air bags belonging to each group. The valves and circuitry is also capable of changing the pressures in each of the sets of air bags mounted to each section of the frame to selectable maximum and minimum values above and below the baseline pressure in a repetitive and cyclical fashion.

43 Claims, 14 Drawing Sheets

ALTERNATING PRESSURE LOW AIR LOSS BED

This application is a continuation of co-pending application Ser. No. 07/181,922, filed on Apr. 15, 1988, now abandoned, which is a continuation-in-part of co-pending application Ser. No. 057,695, filed on June 1, 1987, now abandoned, which is a continuation-in-part of co-pending application Ser. No. 905,553, filed on Sept. 9, 1986, now abandoned, which is a continuation-in-part of copending-pending application Ser. No. 784,875, filed on Oct. 4, 1985, now abandoned, which is a continuation-in-part application of co-pending application Ser. No. 683,153, filed on Dec. 17, 1984, now abandoned.

BACKGROUND OF THE INVENTION

The present invention relates to a method and apparatus for alternating the pressure points of a low air loss bed. The advantages of such an apparatus as well as the particular problems solved by this invention are discussed below.

Low air loss beds use inflatable cushions or air bags as the supporting surface for a patient. By using a fluid supporting medium such as air within the bags, an irregularly shaped body placed on top of the air bags will deform the supporting surface in such a manner so as to provide a more uniform distribution of load bearing pressure points than can be attained with a conventional mattress. When a patient lies supinely on a flat surface, or even on a conventional mattress, most of the load is borne by protuberances of the posterior surface of the body such as the heels, the buttocks, the scapula, and the occipital region of the head. The relatively small areas of soft tissue at these points are then subjected to high pressures by being compressed between the skeleton and the supporting surface. When this pressure becomes great enough to cause collapse of small capillaries and veins, pressure sores may result. By uniformly distributing the supporting pressure points along the body surface, the pressure at these critical areas can be reduced. Patients are also predisposed to pressure sores by the accumulation of moisture at the skin surface. For this reason, air bags which are permeable to water vapor are preferred. A continuous flow of air through the bags from a source of pressurized air is then necessary to remove the water vapor, the air being exhausted through separate outlets or pores in the fabric of the bags. It is this feature which distinguishes a low air loss bed from a simple inflatable mattress.

U.S. Pat. No. 3,822,425 discloses a low air loss bed consisting of a number of cells or bags, each having a surface which supports the patient, formed from a material which is said to be gas permeable but non-permeable to liquids and solids. That patent also discloses an air supply for inflating the cells to the required pressure and outlets or exhaust ports in the cells to allow the escape of air. The bed disclosed is divided into sections, each of which comprises a group of air bags. Each section is provided with a pressure sensor and a control valve allowing each section of the bed to be inflated to different pressures. Alternatively, the air pressure in each section is controlled by valves in the outlets from the section.

Low air loss beds of the type disclosed in the '425 patent are typically also provided with means for adjusting the patient's attitude on the bed. For instance, the head of the bed can be raised to sit the patient up or the angle of the entire frame of the bed can be changed with respect to the horizontal when, for therapeutic reasons, the patient is placed in the Trendelenburg or reverse Trendelenburg positions. Those changes require re-adjustment of the air supply in each section of air bags. Movement of the patient may also necessitate adjustment of the pressure in each section as the patient's weight distribution on the bed changes.

Various other approaches have been taken to solving the problem of preventing bedsores in bedridden patients. One common approach is the use of what is referred to as an alternating pressure mattress. Such mattresses are comprised of two sets of alternately inflatable, interdigitated cells or tubes either connected to form a mattress or formed from closely approximated sheets of air impermeable material which have been heat sealed or otherwise bonded at the edges and with tubes or channels formed therein to form alternating cells. Such mattresses are disclosed in, for example, U.S. Pat. Nos. 3,595,223, 4,193,149, and 4,391,009. In all such mattresses, a separately controllable air supply is provided to each set of cells. By alternately inflating and deflating each set of cells in opposite phase to the other set, the supporting surface of the mattress is alternated between each set of cells. The object of these devices is to periodically relieve and transfer points of contact between the patient's body and the supporting surface. These devices, however, are not low air loss beds. This means that the pressure in each set of cells is merely varied from a full inflate to a full deflate condition. Alternating pressure mattresses have not been designed in the past to provide the uniform patient support provided by low air loss beds. Some have even been designed to do the opposite in order to provide a vigorous massaging action.

The degree of uniformity of support provided by a low air loss bed varies with the pressure existing within the air bags for any given patient. The pressure exerted against a body resting on an air bag is approximately equal to the air pressure within the bag when the air bag is deformed only to an extent which flattens the body contacting surface of the bag. Further deformation increases the pressure exerted by the bag surface against the body because the body contacting surface of the bag, in addition to being pushed by the air pressure within the bag, is pulled by the tension existing in the bag fabric surrounding the body. This tension is maintained by the air pressure exerted against the inner surfaces of the bag which surround the body. In any case, of course, the pressure exerted against the body by the bag surface integrated over the total body contacting surface equals the weight of the body.

In order to maximize the uniformity of support provided by a low air loss bed, the air pressure within the bags should be maintained at a value low enough to allow the supporting surface to be deformed in order to increase the weight bearing surface area but not low enough that too much tension is produced in the bag fabric surrounding the body contacting surface. Such tension in the fabric interferes with the deformation of the supporting surface by protruding body parts. Therefore, for a body of any particular size and weight, there exists a pressure value which maximizes the degree of uniformity of support provided to the body by the air bag. Since weight is not distributed evenly on the human frame, this ideal pressure value varies with different body regions. Heavier regions such as the buttocks require greater pressure to achieve uniform support while lighter regions such as the feet require less pressure.

Of course, no matter how uniform the support provided to a patient by a low air loss bed, areas of the patient's body necessarily are subjected to some pressure. Furthermore, for the reasons discussed above, protruding areas of the body are subjected to relatively greater pressure. It would be advantageous, therefore, for the pressure points in a low air loss bed to be periodically shifted from one body area to another without compromising the uniform supporting characteristics of a low air loss bed.

A low air loss bed which also incorporates some of the characteristics of an alternating pressure mattress would present a number of advantages. Periodically relieving alternate body areas of pressure would ensure that no body area becomes completely ischemic due to excessive support pressure. Also, if the bags are positioned transversely, periodically increasing the pressure to alternate body areas has the effect of compressing subcutaneous veins which, owing to the one-way valves existing in human veins, provides an impetus to the flow of blood back to the heart. Not only does this improve arterial circulation, but it also makes less likely venous pooling which can cause edema and predispose the patient to pressure sores.

In order not to compromise the uniform supporting characteristics of the low air loss bed, however, the air bags cannot simply be separated into two sets, interdigitated, connected to two separate pressure sources, and then alternately inflated and deflated. As aforesaid, an ideal air bag pressure exists for each patient of a particular size and weight which maximizes the degree of uniformity of support. After being determined empirically, the ideal pressure should be maintained in each bag within limits. Furthermore, this ideal pressure varies with the particular body region being supported by a group of air bags. What is needed, therefore, is a low air loss bed which allows operator selection of the air bag pressure for each set of air bags supporting a particular body region and maintains that ideal Pressure as a setpoint or baseline value about which the pressures are raised and lowered as the pressure points are alternately shifted from one set of interdigitated bags to another.

It would be further advantageous for such a low air loss bed to allow the operator to select the degree of relative increase and decrease from the ideal pressure for each set of air bags when in the alternating pressure mode.

Yet another advantage would accrue if the setpoint pressure could be automatically changed for the different sets of air bags as different sections of the bed frame are adjusted from the horizontal.

SUMMARY OF THE INVENTION

These advantages are accomplished in the present invention by providing low air loss beds with a frame having a plurality of sections pivotable with respect to each other, each section corresponding to a portion of the body of a patient supported on the bed. First and second sets of water vapor permeable air bags are mounted transversely to each of the sections. The air bags of the first set of air bags are mounted alternately in between the air bags of the second set of air bags on each section so as to form an interdigitated supporting surface. A means for maintaining a preselected baseline or setpoint pressure in the group of air bags mounted to each section of the frame is provided, as is a means for separately sensing the pressure in the air bags of the first and second sets of air bags mounted to each section. A means is also Provided for changing the pressure in the air bags of each of the first and second sets of air bags mounted to each section in response to the changes in the signal from a pivot sensing means when the sections are pivoted with respect to each other.

Also provided is a source of pressurized air for supplying air to separate gas manifolds communicating with the interior of the air bags belonging to each set and each section. An air control box is mounted to the bed frame and interposed in the flow of air from the air source to the air manifolds, and is provided with individually adjustable valves for changing the amount of air supplied to each of the air manifolds. The air control box is also provided with means for selectively opening all of the valves to the atmosphere, allowing the gas to escape from each of the sets of air bags to collapse the air bags with the result that the patient is supported by the frame of the air bed rather than the air bags. This facilitates performance of cardiopulmonary resuscitation procedures. The air control box is also provided with means for simultaneously fully opening the valves to cause the air bags to fully inflate. There also exists means for heating the air flowing through the air control box with a means for switching the heating means on and off in response to the temperature in the air control box.

Maximum and minimum pressures defined as target pressures above and below the baseline pressure can be preselected for each of the first and second sets of air bags. Means are provided for alternately changing the pressure in the first set of air bags to the maximum target pressure while changing the pressure in the second set to the minimum target pressure and vice-versa in cyclical and repetitive fashion. In this way, the pressure points on the supporting surface of the bed to which a patient is subjected are alternated without compromising the uniform support characteristics of the low air loss bed.

DETAILED DESCRIPTION OF THE PREFERRED EMBODIMENTS

Figure 1:
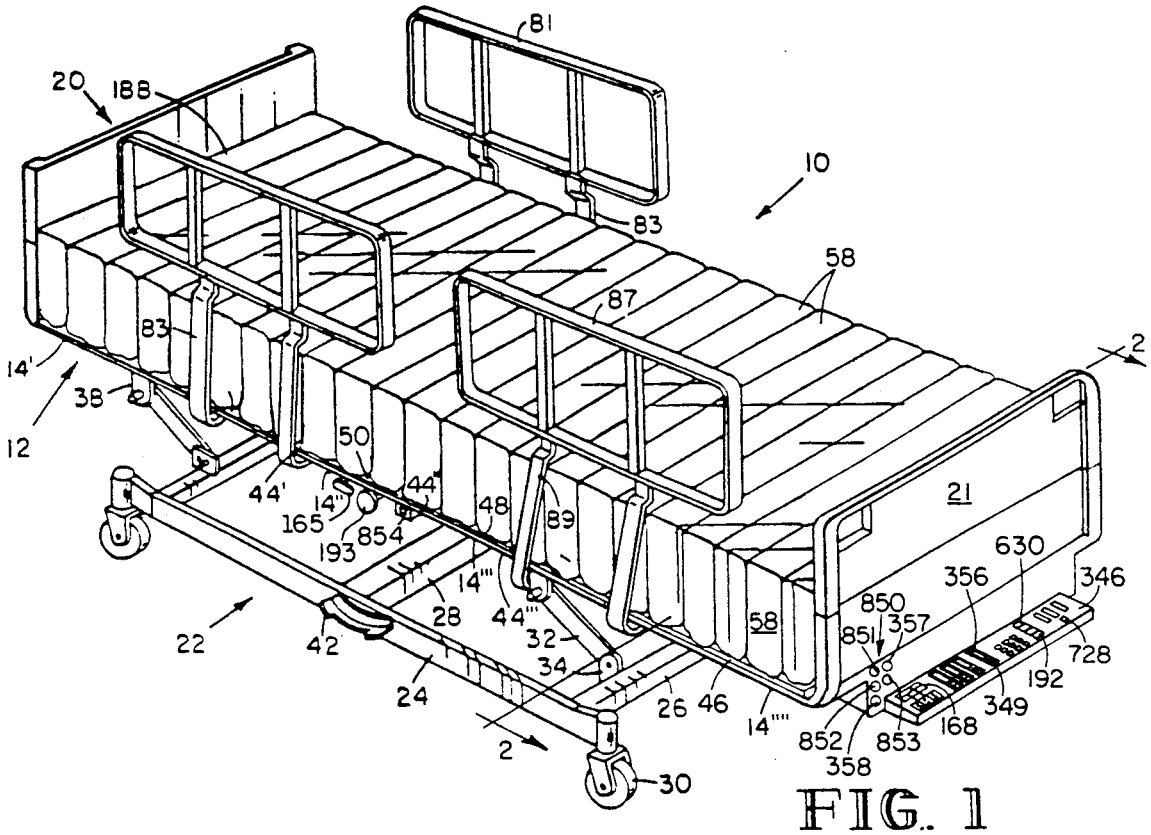
FIG. 1 is a perspective view of a presently preferred embodiment of the patient support system of the present invention.
Figure 6:
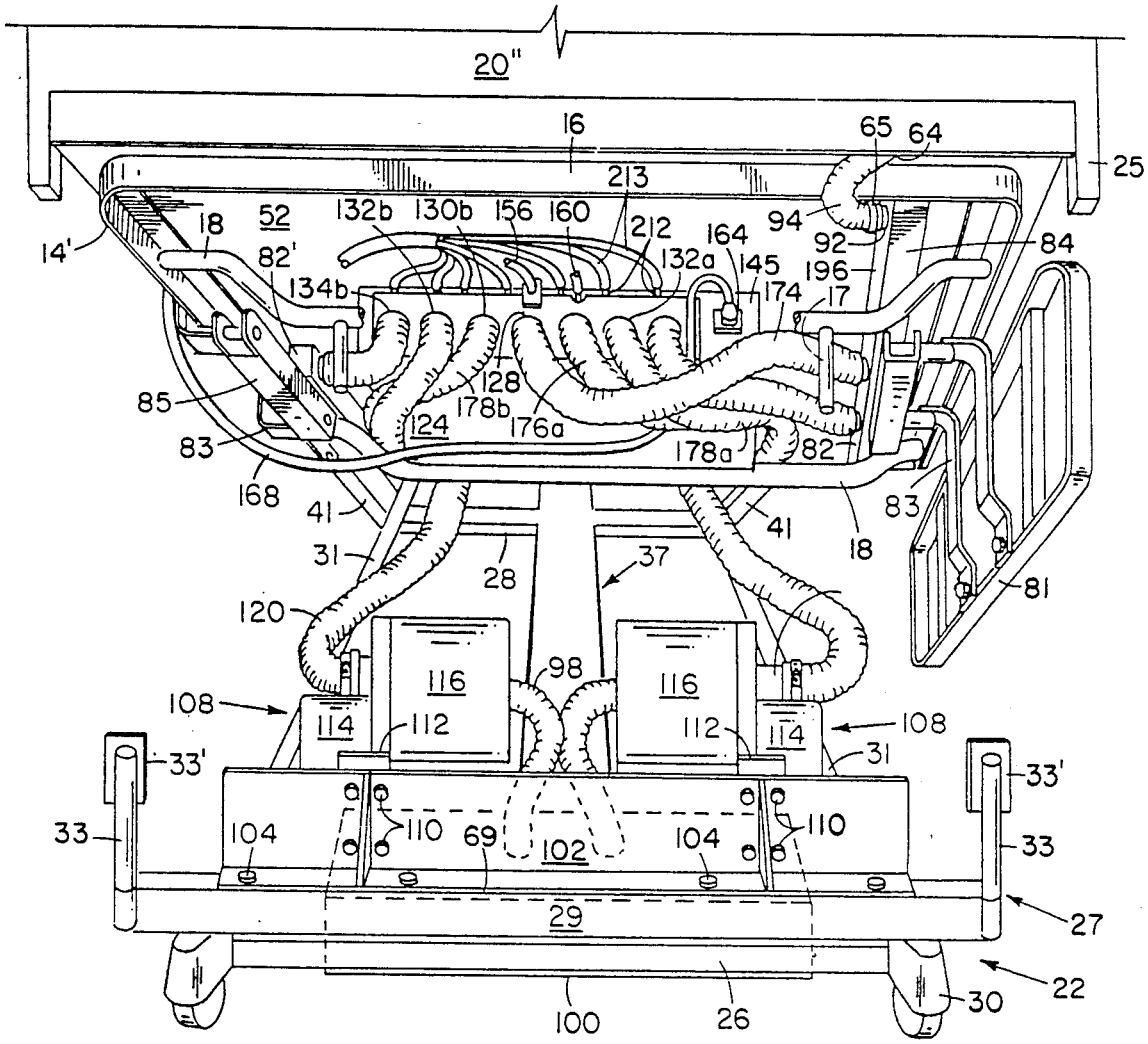
FIG. 6 is an end view of the patient support system of FIG. 1 with the head portion raised to show the construction of the frame the components mounted thereto.
Figure 7:
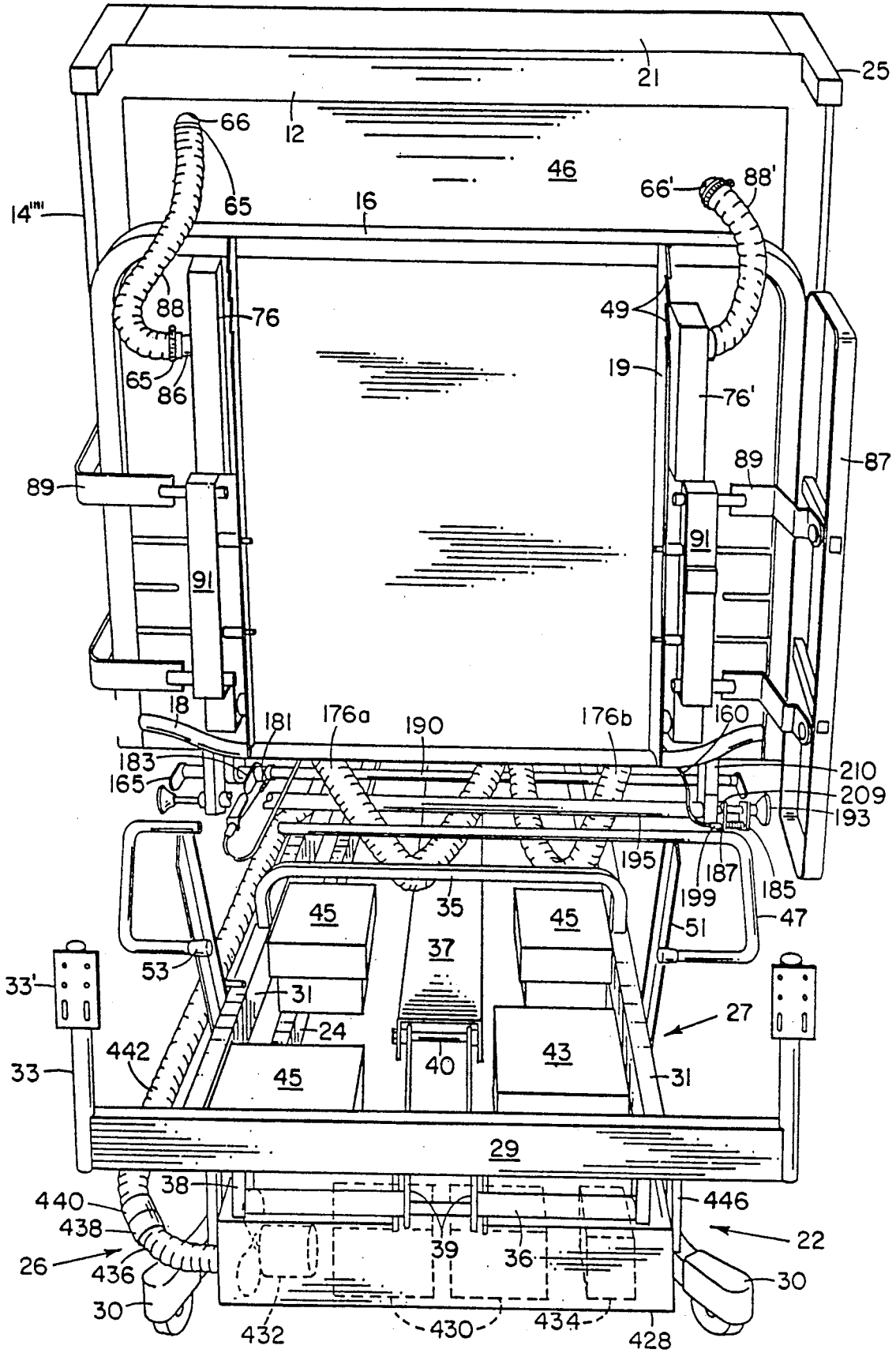
FIG. 7 is an end view of the patient support system of FIG. 1 with the foot portion raised to show the construction of the frame and the components mounted thereto.

Referring to FIGS. 1, 6 and 7, there is shown a patient support system 10 including a frame 12. The frame 12 is comprised of a plurality of sections 14', 14'', 14''' and 14'''', hinged at the points 44', 44'' and 44''', and end members 16. Cross-members 18 (FIGS. 6 and 7) and braces 19 (FIG. 7) are provided for additional rigidity. The frame 12 is provided with headboard 20 at one end and a foot board 21 at the other end.

A separate sub-frame, indicated generally at reference numeral 27 in FIGS. 6 and 7, is mounted on a base 22 comprised of longitudinal beams 24, cross-beams 26 and cross-member 28 by means of a vertical height adjustment mechanism as will be described. The base 22 is mounted on casters 30 at the corners of the base 22. A foot pedal 42 is provided for braking and steering the casters 30.

Sub-frame 27 is comprised of cross beams 29, hoop brace 35, and longitudinal beams 31 (see FIGS. 6 and 7). Sub-frame 27 is provided at the corners with uprights 33, having tabs 33' thereon, for mounting of IV bottles and other equipment. Means is provided for raising and lowering the sub-frame 27 relative to the base 22 in the form of a conventional vertical height adjustment mechanism, not all of the details of which are shown. Height is adjusted by rotation of an axle under influence of a power screw, hidden from view in FIG. 7 by drive tunnel beam 37, which is powered by a motor which is also hidden from view. Power is transferred from the power screw to an axle by means of eccentric levers journaled in and hidden by drive tunnel beam 37. Sub-frame 27 rises on levers 32 which are pivotally mounted to the cross-beams 26 of base 22 by members 34 and to frame 12 by the ears 38 which are mounted to the longitudinal beams 31 of subframe 27.

The section 14'' of frame 12 is mounted to the longitudinal beams 31 of sub-frame 27 by support members 41 (see FIG. 6). The section 14' of frame 12, with the head baseboard 52 thereon, and the section 14'''' of frame 12, with foot baseboard 46 thereon, pivot upwardly from the horizontal at the hinges 44' and 44'40 40 , respectively. The purpose of that pivoting is to provide for the adjustment of the angle of inclination of the various parts of the body of the patient, and the details of that pivoting are known in the art and are not shown for purposes of clarity, although the motors are located within the boxes shown at 45 and are controlled by the switches 233, 235, 236, 237, 238, and 239 on control Panel 346, or from the redundant controls on bed hand control 361 (see FIG. 12), and the circuitry for those functions is contained within box 43 (FIG. 7).

Supports 17 (see FIG. 6) are provided on the cross member 18 under head baseboard 52 which rest on the longitudinal beams 31 of sub-frame 27 when head baseboard 52 is horizontal. When foot baseboard 46 is raised (FIG. 7), cross-bar 47 rises therewith by means of the pivoting connection created by cross-bar 47 and the notches 49 in brace 19 (cross-bar 47 is shown detached from braces 19 in FIG. 7 for purposes of clarity). The sets of notches 49 provide means for adjusting the height to which cross-bar 47 can be raised, cross-bar 47 pivoting on brackets 51 which are pivotally mounted to the longitudinal beams 31 of sub-frame 27. The tips 53 of cross-bar 47 rest on longitudinal beam 31 when foot baseboard 46 is lowered to the horizontal.

Side rails 81 are mounted to brackets 83 (see FIG. 6) which are pivotally mounted to the mounting brackets 85 mounted on the underside of head baseboard 52. Side rails 87 are mounted to brackets 89 (see FIG. 7), and brackets 89 are pivotally mounted to the mounting brackets 91. Mounting brackets 91 are affixed to the braces 19 on the underside of foot baseboard 46.

Figure 2:
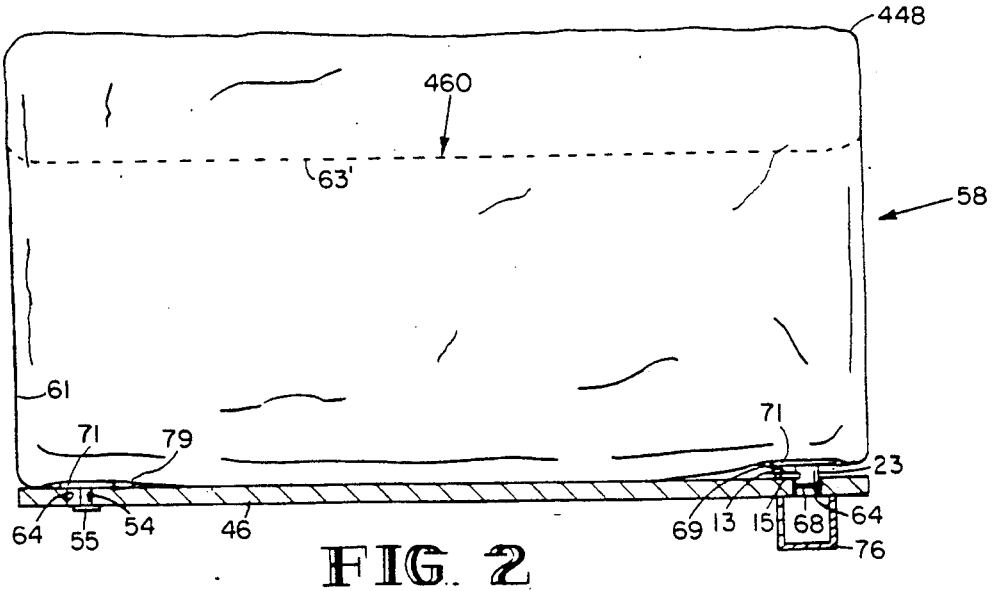
FIG. 2 is a cross-sectional view of the patient support system of FIG. 1 taken along the lines 2—2 in FIG. 1.
Figure 4:
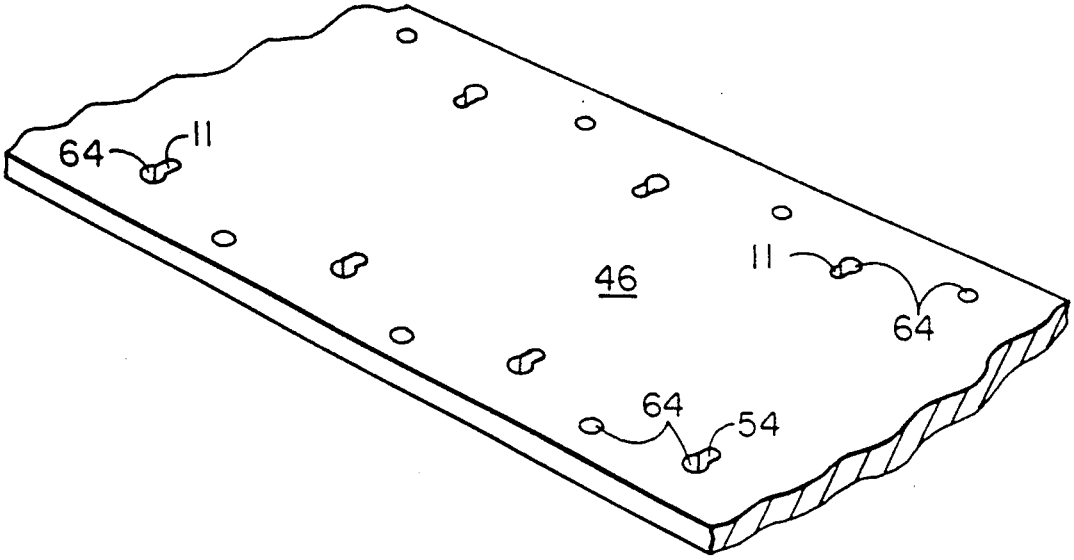
FIG. 4 is a perspective view of one of the baseboards of the patient support system of FIG. 1.
Figure 5:
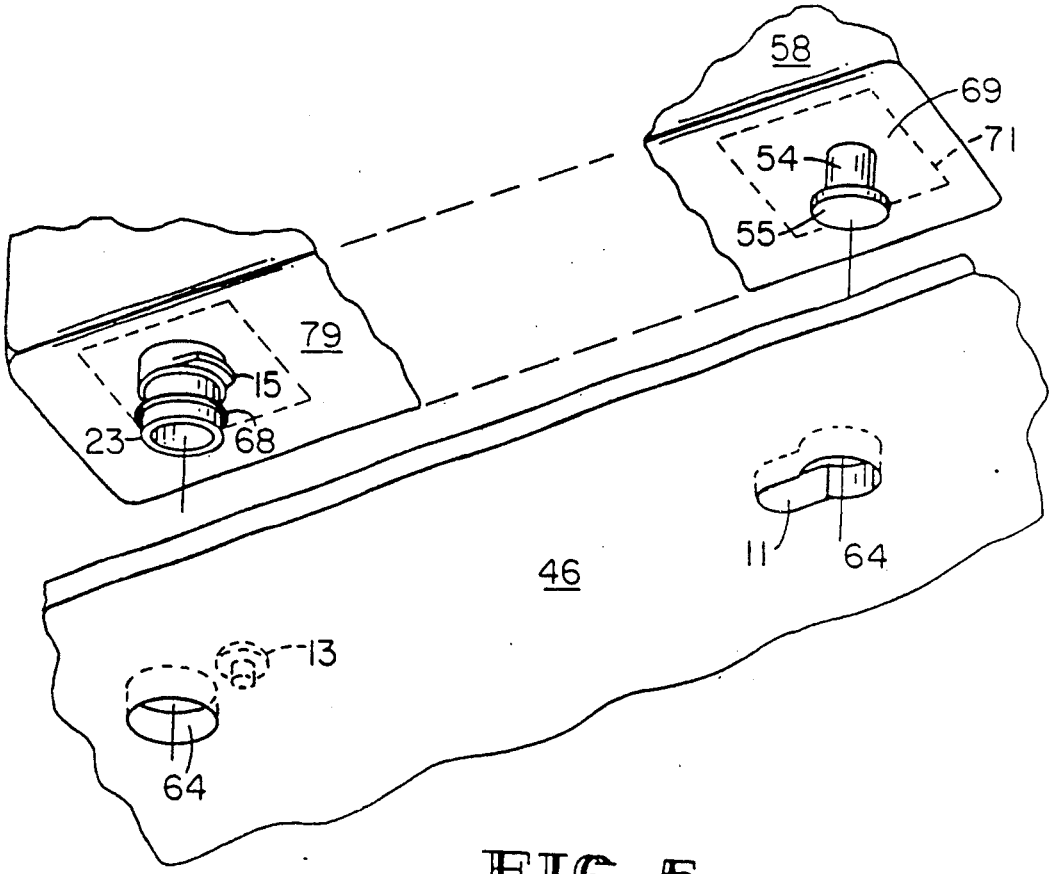
FIG. 5 is an enlarged, exploded perspective view of the underside of the baseboard of FIG. 4, showing the baseboard partially cut away to show the details of attachment of a low air loss air bag thereto.

The frame 12 is provided with a feet baseboard 46, a leg baseboard 48, a seat baseboard 50 and a head baseboard 52 (shown in shadow lines in FIG. 3), each being mounted to the corresponding section 14', 14'', 14''' and 14'''' of the frame 12. Means is provided for releasably securing air bags 58 to each of the baseboards 46, 48, 50 and 52. Referring to FIGS. 2, 4, and 5, there is shown a presently preferred embodiment of that releasable securing means. In FIGS. 4 and 5, there is shown a portion of the feet baseboard 46, which is provided with holes 64 therethrough which are alternating and opposite each other along the length of the feet baseboard 46, as well as leg baseboard 48, seat baseboard 50 and head baseboard 52. Every other hole 64 on each side of the baseboards is provided with a key slot 11 for receiving the post 54, having retainer 55 mounted thereon, which projects through the bottom surface 79 of air bag 58, the flange 71 of which is retained between patch 69, which is stitched to the bottom surface 79 of air bag 58, and the bottom surface 79. Air bag 58 is shown cutaway and in shadow lines in FIG. 5 for purposes of clarity. Air bag 58 is also provided with a nipple 23 of resilient polymeric plastic material having an extension tab 15 integral therewith and secured in the bottom surface 79 of air bag 58 in the same manner as post 54 is secured thereto. To releasably secure the air bag 58 to feet baseboard 46, or any of the other baseboards 48, 50, or 52, post 54 is inserted through hole 64 until retainer 55 has emerged from the bottom thereof. Post 54 is then slid into engagement with key slot 11 and retainer 55 engages the bottom side of feet baseboard 46 around the margin of hole 64 to retain air bag 58 in place on feet baseboard 46. Nipple 23 is then inserted into the hole 64 opposite the hole 64 having key slot 11 therein and rotated until extension tab 15 engages the bottom of the head of flat head screw 13 to help secure nipple 23 in place.

Referring to FIG. 2, the air bags 58 are substantially rectangular in shape, and are constructed of a coated fabric or similar material through which water vapor can move, but which water and other liquids will not penetrate. The fabric sold under the trademark "GORE-TEX" is one such suitable material. The air bags 58 can include one or more outlets for the escape of the air with which they are inflated or they can be constructed in a "low air loss" conformation. The air bags 58 may be constructed in a "low air loss" conformation. The low air loss air bag shown at reference numeral 58 in FIG. 2 can be a composite of a gas impermeable fabric, which makes up the bottom 79 and the walls 61 of the air bag 58, and the gas permeable fabric described above, which makes up the top 63 of the air bag. The top 63 and walls 61 are stitched or otherwise joined at shadow lines 63'. The gas impermeable fabric of the walls 61 and bottom 79 is, for instance, a polymer-coated nylon. The use of a low air loss air bag 58 allows the pressurization of the air bag 58 with a smaller flow of gas, which results in the possibility of maintaining sufficient pressure with just one blower 108 operating while using low air loss air bags 58.

As noted above, all of the air bags 58 are substantially rectangular in shape with dimensions of approximately 14×39 inches. A baffle 460 is attached to the side walls 61 of each air bag 58 by stitching 63' to hold the side walls 61 against bowing when the air bag 58 is inflated. Each of the corners 448 of air bag 58 has a radius of curvature of approximately three inches, and the use of individual air bags 58 rather than a single air cushion allows the replacement of individual bags should one develop a leak, need cleaning or otherwise need attention. When it is desired to remove an individual air bag 58 from its respective baseboard 46, 48, 50, or 52, post 54 is slid out of key slot 11 and retainer 55 and post 54 are removed from hole 64. Nipple 23 is then rotated until extension tab 15 rotates out of engagement with screw 13 and is pulled firmly to remove it from hole 64. Removal can even be accomplished while the patient (not shown) is lying on the inflated air bags 58.

Referring to FIG. 6, there is shown an end view of a bed constructed according to the present invention. Brace 102 is secured to the cross beam 29 of sub-frame 27 by means of bolts 104. Blowers 108 are mounted to the brace 102 by means of bolts 110 through the mounting plates 112 which are integral with the blower housing 116. A gasket, piece of plywood or particle board (not shown), or other sound and vibration dampening material is interposed between mounting plates 112 and brace 102. A strip of such material (not shown) can also be inserted between brace 102 and cross beam 29. The blowers 108 include integral permanent split capacitor electric motors 114. When motors 114 are activated, blowers 108 move air out of the blower housings 116, through the blower funnels 118 and up the blower hoses 120 to the air box funnels 122 and on into the air box 124 (see FIGS. 3, 8, 9A and 9B).

Figure 3:
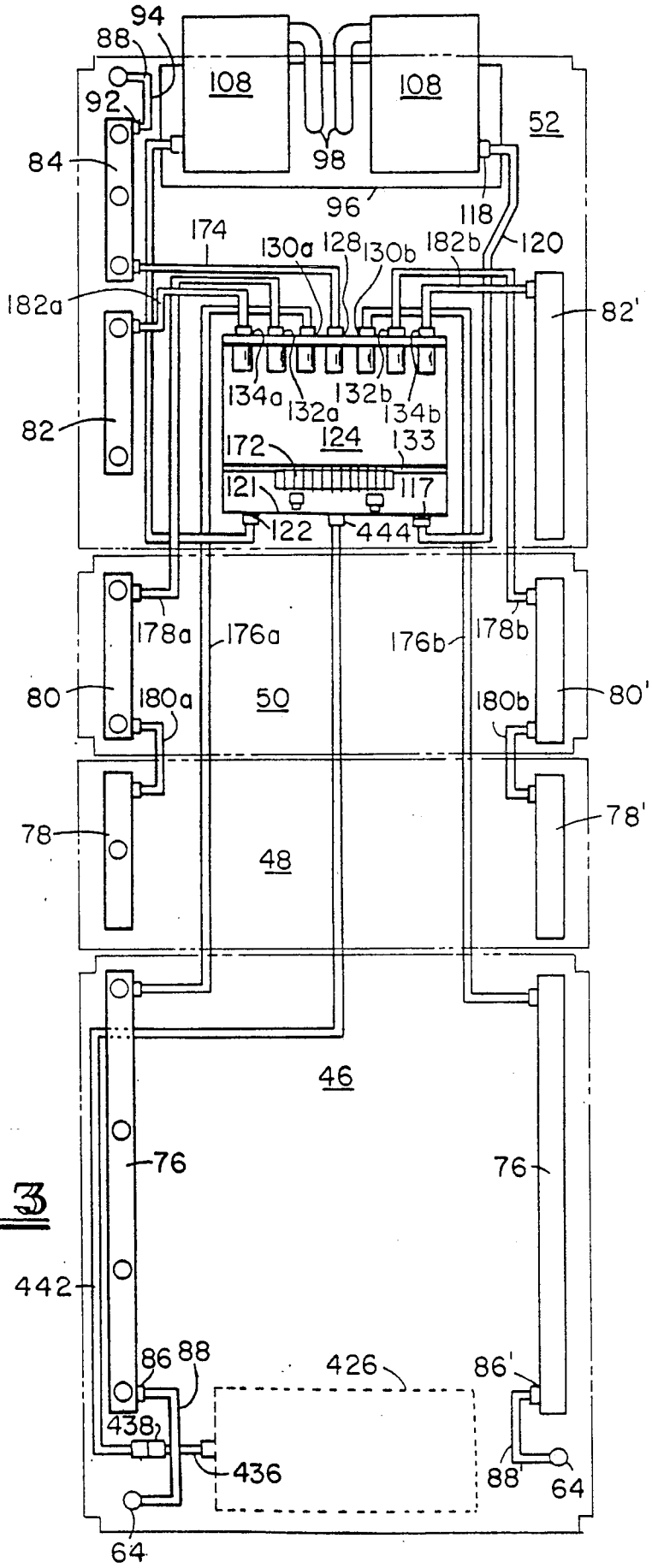
FIG. 3 is a schematic diagram of the air plumbing of the patient support system of FIG. 1.

Blowers 108 receive air from filter box 96 through hoses 98 (see FIG. 3). Filter box 96 is retained within a frame 100 (see FIG. 6) for ease in removal. Frame 100 is mounted to frame 27 and is, for the most part, blocked from view by cross-beam 26 of base 22 and cross beam 29 of frame 27 in FIG. 6. The second blower 108 is provided to increase the volume which is delivered to the air bags 58, thereby increasing the air pressure within air bags 58. A cover (not shown) lined with sound absorbing material can also be provided to enclose blowers 108 and thereby reduce noise.

Figure 8:
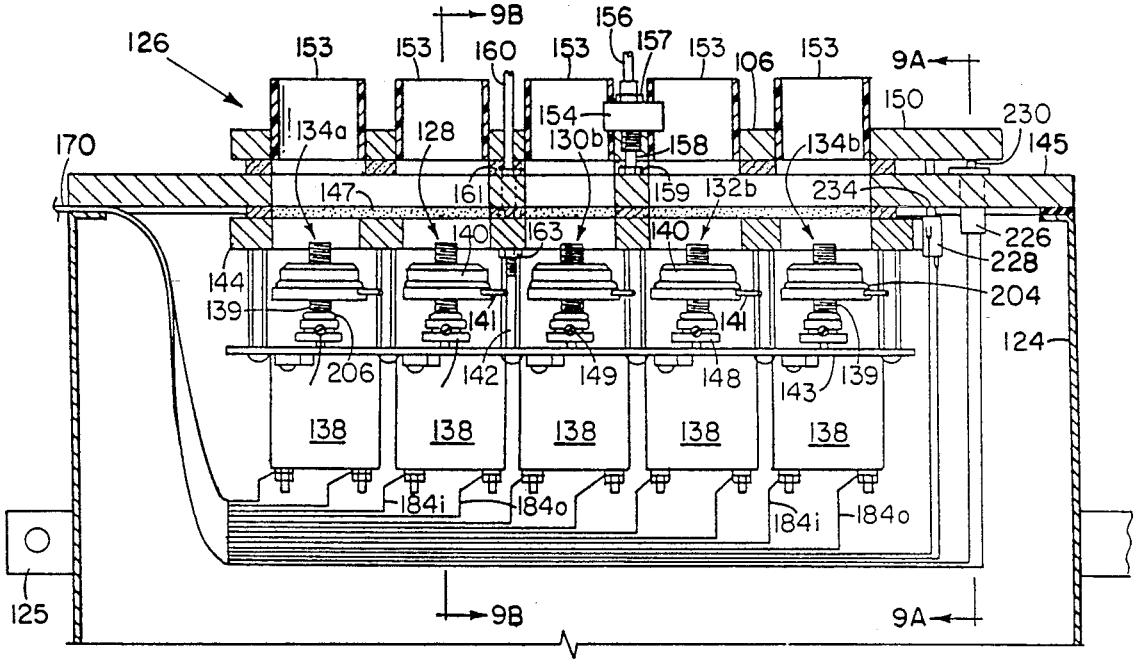
FIG. 8 is a sectional view of the air box of the patient support system of FIG. 1 taken along the lines 8—8 in FIG. 9A.

The air control box 124 is an airtight box mounted on the underside of head baseboard 52 by brackets 125, the details of which are shown in FIG. 8. The front of air box 124 is provided with a manifold assembly 126. Manifold assembly 126 is provided with a manifold plate 145 having holes (not numbered) therein for connection to a means for changing the amount of air supplied to the air bags 58 mounted to baseboards 46, 48, 50 and 52 in the region of the feet, legs, seat, back, and head, respectively. Gasket 115 prevents the escape of air from between air box 124 and manifold plate 145. In a presently preferred embodiment, the means for changing the amount of air supplied to the air bags 58 takes the form of a plurality of valves, indicated generally at reference numerals 128, **130*a* and 130*b*, 132*a* and 132*b*, and 134*a* and 134*b* (see also FIG. 3). Each of the valves 128, 130*a* and 130*b*, 132*a* and 132*b*, and 134*a* and 134*b* is provided with a motor 138 having a nylon threaded shaft 139 (see FIGS. 8, 9A and 9B) mounted on the drive shaft (not numbered) of each motor 138 and held in place by set screw 149 in collar 148. Plug 140 moves rotatably in and out along the threaded shaft 139 when limit pin 141 of plug 140 engages one or the other of the supports 142 which are immediately adjacent that particular plug 140 and which hold the motor mounting bracket 143 to the back of the full inflate plate 144**.

Figure 9A:
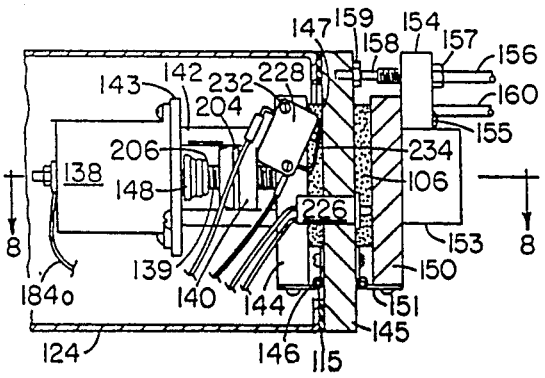
FIGS. 9A and 9B are cross-sectional views taken along the lines 9A—9A and 9B—9B, respectively, through the manifold assembly of the air box as shown in FIG. 8.
Figure 9B:
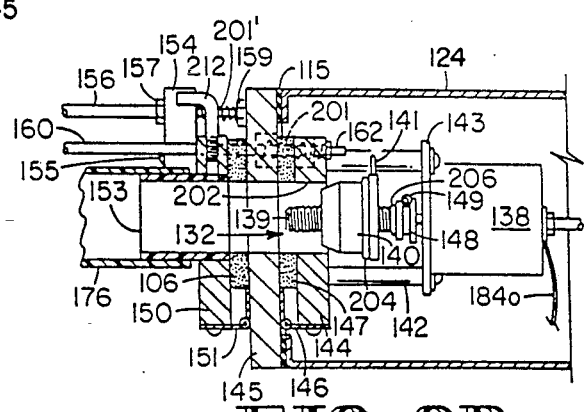

Full inflate plate 144, having openings 202 therein forming part of valves 128, **130*a* and 130*b*, 132*a* and 132*b*, and 134*a* and 134*b*, is mounted to the back of the manifold plate 145 by hinges 146 (see also FIGS. 9A and 9B). A gasket 147 is provided to prevent the escape of air from between the full inflate plate 144 and manifold plate 145. The motors 138 are not provided with limit switches, the movement of plug 140 back and forth along the threaded shaft 139 of each motor 138 being limited by engagement of plug 140 with the opening 202 as plug 140 moves forward and by the engagement of the back side of plug 140 with collar 148 as plug 140 moves back on threaded shaft 139. An 0-ring 204 is provided on plug 140 which is compressed between plug 140 and opening 202 as plug 140 moves forward into opening 202. Compression continues until the load on motor 138 is sufficient to cause it to stop. The 0-ring 206 which is provided on collar 148 operates in similar fashion when engaged by the back side of plug 140**.

The stopping of motors 138 by the loading of O-rings 204 and 206 facilitates the reversal of the motors 138 and direction of travel of plug 140 along threaded shaft 139 because threaded shaft 139 is not bound. Threaded shaft 139 is free to reverse direction and turn such that the load created by the compression of 0-rings 204 or 206 is released by the turning of threaded shaft 139, and plug 140 will rotate with threaded shaft 139 until limit pin 141 contacts support 42, stopping the rotation of plug 140 and causing it to move along shaft 139 as it continues to turn.

A dump plate 150 is mounted on the outside of manifold plate 145 by means of hinges 151 (see FIGS. 9A and 9B). A gasket 106 is provided to prevent the escape of air from between the manifold plate 145 and the dump plate 150. The dump plate 150 is provided with couplers 153, the interiors of which are continuous with the holes in manifold plate 145 when dump plate 150 is in the position shown in FIGS. 8, 9A, and B, for connection of the appropriate bed frame air supply hoses 174, 176*a* and 176*b*, 178*a* and 178*b*, and 182*a* and 182*b*, as will be explained.

Block 154 is attached to dump plate 150 by means of screws 155, and serves as a point at which the cable 156 can be anchored, by means of nut 157, so that a line 158 can slide back and forth within cable 156 to allow the dump plate 150 to be selectively pivoted away from manifold plate 145 on hinge 151. The line 158 is secured to the manifold plate 145 by the threaded cable end and locknut 159. Line 158 is secured at its other end to the bracket 183 mounted on tube 190 (see FIG. 7). Bed frame 12 is provided with quick dump levers 165 on both sides thereof, the quick dump levers 165 being connected by lube 190 so that both levers 165 provide a remote control for operation of dump plate 150 by causing the movement of line 158 through cable 156. When either of quick dump levers 165 is moved from the position shown in FIG. 7, eccentric lever arm 181 pulls on line 158, cable 156 being anchored on bracket 183, so that line 158 moves through cable 156. The details of the anchoring of cable 156 and movement of line 158 therethrough under the influence of lever arm 181 are the same as those for the anchoring of cable 160 and movement of line 162 therethrough under the influence of lever arm 185 (see below). Movement of line 158 causes dump plate 150 to pivot away from manifold plate 145, allowing the air in air bags 58 to escape through manifolds 76, 78, 80, 82 and 84 and bed frame air supply hoses 174, 176*a*, 178*a*, 180*a*, 176*b*, 178*b*, and 180*b* to the atmosphere from the opening thus created between manifold plate 145 and dump plate 150 so that air bags 58 will rapidly deflate. A coil spring 201' encloses line 158 within bores (not numbered) in dump plate 150 and manifold plate 145 to bias dump plate 150 and manifold plate 145 apart.

As is best shown on FIGS. 8 and 9B, a separate cable 160 passes through manifold plate 145 in threaded fitting 161 so that line 162 can slide back and forth therein. The line 162 is anchored in the full inflate plate 144 by means of nut 163, which allows the full inflate plate 144 to pivot away from the manifold plate 145 on hinge 146. Pivoting of full inflate plate 144 away from manifold plate 145 in this manner removes full inflate plate 144, motor mounting bracket 143, and all other parts mounted to those parts, from the flow of air to allow the unrestricted entry of the air in air box 124 into the couplers 153 of valves 128, 130*a* and 130*b*, 132*a* and 132*b*, and 134*a* and 134*b* and on into bed frame air supply hoses 174, 176*a* and 176*b*, 178*a* and 178*b*, and 182*a* and 182*b*, resulting in the rapid and full inflation of air bags 58 to raise the patient on air bags 58 to facilitate patient transfer or other needs. A coil spring 201 encloses line 162 in a bore (not numbered) in manifold plate 145 and full inflate plate 144 to bias manifold plate 145 apart from full inflate plate 144.

Line 162 is anchored at the end opposite full inflate plate 144 on lever arm 185 (FIG. 7) which is attached to the bar 195 upon which full inflate knob 193 is mounted. Bed frame 12 is provided with full inflate knobs 193 on both sides thereof, the full inflate knobs 193 being connected by bar 195 so that both control the movement of line 162 through cable 160. Cable 160 is affixed to bracket 187 by threaded cable end 199, which is mounted on the DELRIN synthetic plastic bearing 209 which is integral with support member 210 and which receives bar 195 so that rotation of full inflate knobs 193 causes line 162 to slide therein, pivoting full inflate plate 144 on hinge 146. The weight of motors 138, supports 142 and motor mounting bracket 143 bias full inflate plate 144 toward the position in which full inflate plate 144, motor mounting bracket 143, and the parts mounted thereto, are removed from the flow of air into the couplers 153 of valves 128, 130*a* and 130*b*, 132*a* and 132*b*, and 134*a* and 134*b*. This bias allows knobs 193 to act as a release such that either of knobs 193 need only be turned enough to move the connection between line 162 and lever arm 185 out of its over center position, at which point gravity causes the Plate 144 to open. When knobs 193 are returned to their initial position, lever arm 185 turns to the point at which the connection between line 162 and lever arm 185 is rotated past 180° from the point at which line 162 approaches bar 195, i.e., over center. As noted below, the microprocessor 240 included within controller 198 includes an alarm buzzer (not shown). Switches can be provided for activating that alarm when either of knobs 193 or levers 165 are used to inflate or deflate air bags 58.

Air enters the air box 124 through air box funnels 122 in back plate 121 (FIG. 3). Air box funnel 122 is provided with a one-way flapper valve, shown schematically at reference numeral 117, so that air will not escape from the air box 124 when only one blower 108 is being operated. The air box 124 is provided with a heating strip indicated schematically at reference numeral 172. Heating strip 172 is mounted in bulkhead 133 in air box 124, effectively partitioning air box 124 into two compartments. Because air enters the air box 124 in one compartment (i.e., behind heating element 172) and leaves the air box 124 from the other compartment, a flow of air must pass through the space 135 between bulkhead 133 in which heating element 172 is mounted, being mixed and heated in the process.

Referring to FIG. 3, blowers 108 are switched on, forcing or pumping air (or other gases) received from filter box 96 through hoses 98 up the blower hoses 120, through one-way valves 117, and into air box 124. The air escapes from the air box 124 through valves 128, 130*a* and 130*b*, 132*a* and 132*b*, and 134*a* and 134*b* into the respective bed frame air supply hoses, 174, 176*a* and 176*b*, 178*a* and 178*b*, and 182*a* and 182*b*. Bed frame air supply hoses 174, 176*a* and 176*b*, 178*a* and 178*b*, and 182*a* and 182*b* route the air to the manifolds 76 and 76', 78 and 78 , 80 and 80', 82 and 82', and 84. Bed frame air supply hoses 178*a* and 178*b* are connected to seat air manifolds 80 and 80 , which are connected by bed frame air supply hoses 180*a* and 180*b* to leg air manifold 78'. Bed frame air supply hoses 182*a* and 182*b* route air to back air manifolds 82 and 82', respectively. Bed frame air supply hose 174 routes air to head air manifold 84. Each of the air manifolds 76 and 76', 78 and 78', 80 and 80', 82 and 82', and 84 is mounted to the underside of the baseboards 46, 48, 50 and 52, feet baseboard 46 having air manifolds 76 and 76' mounted thereto, leg baseboard 48 having air manifolds 78 and 78 mounted thereto, and seat baseboard 50 having air manifolds 80 and 80' mounted thereto. The head baseboard 52, and its corresponding section 14'''' of frame 12, is provided with two back air manifolds 82 and 82' and head air manifold 84.

Figure 11:
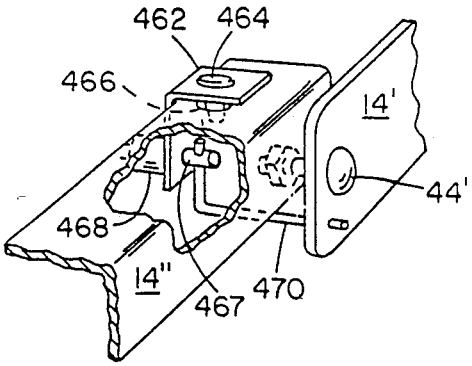
FIG. 11 is a perspective view of a portion of the bed frame of the patient support system of FIG. 1 showing a potentiometer mounted to one frame section which is pivotally connected to an adjacent frame section.

Because the feet baseboard 46 extends beyond the end member 16 of the frame 12 at the foot of the bed, T-intersects 86 and 86' are provided from the feet air manifolds 76 and 76', respectively, to route feet extension hoses 88 and 88' to the holes 64 and 64 at the extreme ends of the feet baseboard 46 (see FIGS. 3, 7 and 11). Clamps 65 are provided to hold the feet extension hoses 88 and 88' in place on the nipples 23 in holes 64 and 64' and on T-intersects 86 and 86'. The head baseboard 52 likewise extends beyond the end member 16 of frame 12 at the head end of the bed (FIGS. 3 and 6), and T-intersect 92 is provided from the head air manifold 84 to provide air to the hole 64 at the extreme end of the head baseboard 52 by means of the head extension hose 94. A clamp 65 is provided to retain head extension hose 94 on T-intersect 92 and on the receptacle 66 in hole 64.

Air enters the air manifolds 76 and 76', 78 and 78', 80 and 80', 82 and 82', and 84 from each respective bed frame air supply hose 174, 176*a* and 176*b*, 178*a* and 178*b*, 180*a* and 180*b*, or 182*a*, and then passes down the length of each air manifold 76 and 76', 78 and 78', 80 and 80', 82 and 82', or 84. Air escapes from the air manifolds 76 and 76', 78 and 78', 80 and 80', 82 and 82', or 84 into the air bags 58 through the holes 64 and 64' in the baseboards 46, 48, 50 and 52, thereby inflating the air bags 58.

As described above, the holes 64 and 64' through base boards 46, 48, 50 and 52 into the air bags 58 are staggered down the length of the frame 12 of patient support system 10. In other words, every other hole 64, or 64', is provided with a key slot 11 (see FIG. 4). Air bags 58 are provided with a single nipple 23, and a post 54 with retainer 55 thereon for engagement of key slot 11 in hole 64 or 64' at the other end thereof. The air bags 58 alternate in their orientation on baseboards 46, 48, 50 and 52, resulting in about half the air bags 58 being oriented with nipple 23 closer to one side of bed frame 12 than the nipple 23 of the other half of the air bags 58 mounted thereon. In this manner, and as will be explained, the air bags 58 of patient support system 10 are divided into first and second sets, i.e., one set having the nipple 23 closer to one side of the bed frame 12 and a second set having the nipple 23 closer to the other side of bed frame 12.

Because each of the bed frame air supply hoses 174, 176*a* and 176*b*, 178*a* and 178*b*, 180*a* and 180*b*, and 182*a* and 182*b* is continuous with a corresponding air manifold 76 and 76', 78 and 78', 80 and 80', 82 and 82', or 84, the amount of air supplied to each air manifold 76 and 76', 78 and 78', 80 and 80', 82 and 82', or 84 can be varied using the valves 128, 130*a* and 130*b*, 132*a* and 132*b*, and 134*a* and 134*b* on the air box 124. Since each of the valves 128, 130*a* and 130*b*, 132*a* and 132*b*, and 134*a* and 134*b* controls the amount of air supplied to one of the manifolds 76 and 76', 78 and 78', 80 and 80', 82 and 82', or 84, each valve 128, 130*a* and 130*b*, 132*a* and 132*b*, 134*a* and 134*b* controls the amount of air supplied to the set of air bags 58 inflated by each individual air manifold 76 and 76', 78 and 78', 80 and 80', 82 and 82', or 84.

As will be explained, means is provided for alternately inflating first the air bags 58 connected to back, seat, leg and feet air manifolds 76, 78, 80 and 82, respectively, and then deflating those air bags while inflating the air bags 58 connected to back, seat, leg and feet air manifolds 76', 78', 80' and 82'. The alternating inflation and deflation of the first set of air bags 58 and the second set of air bags 58 causes the pressure exerted against a patient (not shown) supported thereon to be alternately exerted by a first set of air bags 58 and then by a second set of air bags 58 because of the alternating arrangement of the air bags 58 on baseboards 76, 78, 80, 82 and 84.

To accomplish the changing of the location at which pressure is exerted against the patient, the two sets of air bags 58 are alternately inflated and deflated in a repetitive and cyclical fashion under microprocessor control. Referring to FIG. 3, valves 130*a*, 132*a*, and 134*a* feed air to manifolds 82, 80, 78 and 76. These manifolds feed air to the first set of air bags 58 having their nipples 23 closer to a first side of bed frame 12. Similarly, valves 130*b*, 132*b*, and 134*b* feed air manifolds 82', 80', 78' and 76' which feed air to the second set of air bags 58 having their nipples 23 closer to the second side of bed frame 12, i.e., in fluid connection with manifolds 82', 80', 78' and 76'. Valve 128 feeds air to manifold 84 which supplies air to the air bags 58 supporting the head of the patient. Pressures in each manifold can be controlled by microprocessor 240 (see FIG. 12) by adjustment of the individual valves which supply air to each manifold.

Also shown in FIGS. 3 and 7 is a portable power unit, or transporter, indicated generally at 426. Portable power unit 426 is comprised of case 428, which encloses batteries 430, blower 432 and battery charger 434, and hose 436. Hose 436 is provided with a releasable coupler 438 which mates with the coupler 440 of the hose 442 which is mounted on sub-frame 27 and which connects to air box 124 through funnel 444. Brackets 446 are mounted to subframe 27 for releasably engaging the case 428 of portable power unit 426. Portable power unit 426 provides air pressure to support a patient when an electrical outlet is unavailable, for instance, during patient transport.

Figure 19:
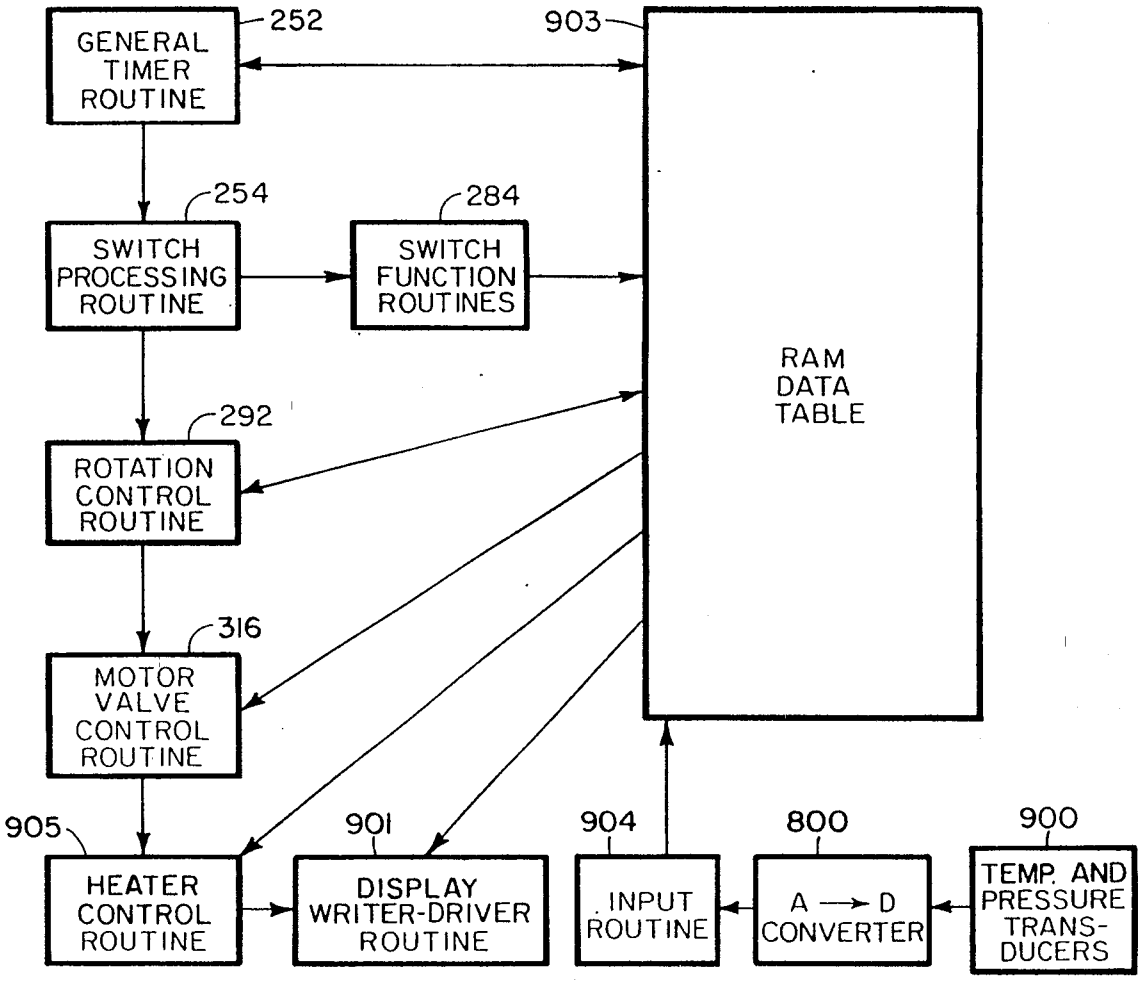
FIG. 19 is a general diagrammatic description of the control software for controlling the operation of the patient support system of FIG. 1.

The microprocessor 240 contained within controller 198 (see FIG. 12) is programmed to operate on an internal interrupt basis. That is, the software idles until a specified number of clock pulses is received, at which point an interrupt signal is generated internally by microprocessor 240. When the software detects this internal interrupt, the various functional software modules shown in FIG. 19 are executed sequentially. Since microprocessor 240 is configured to generate the internal interrupt every fifty milliseconds, the functional software modules of FIG. 19 are executed every fifty milliseconds.

Referring now to FIG. 19, there is shown a block diagram of the functional software modules used to accomplish the control functions of the present invention. Initialization and interrupt driven power-down routines, as described below, are also present in the software but have been omitted from this diagram for simplicity. FIG. 19 merely depicts the application software which is executed every fifty milliseconds by microprocessor 240. Some of the functional modules or routines of FIG. 19 will be described in greater detail below. What follows is an overview of how these routines are integrated to accomplish the objectives of the present invention.

Figure 14:
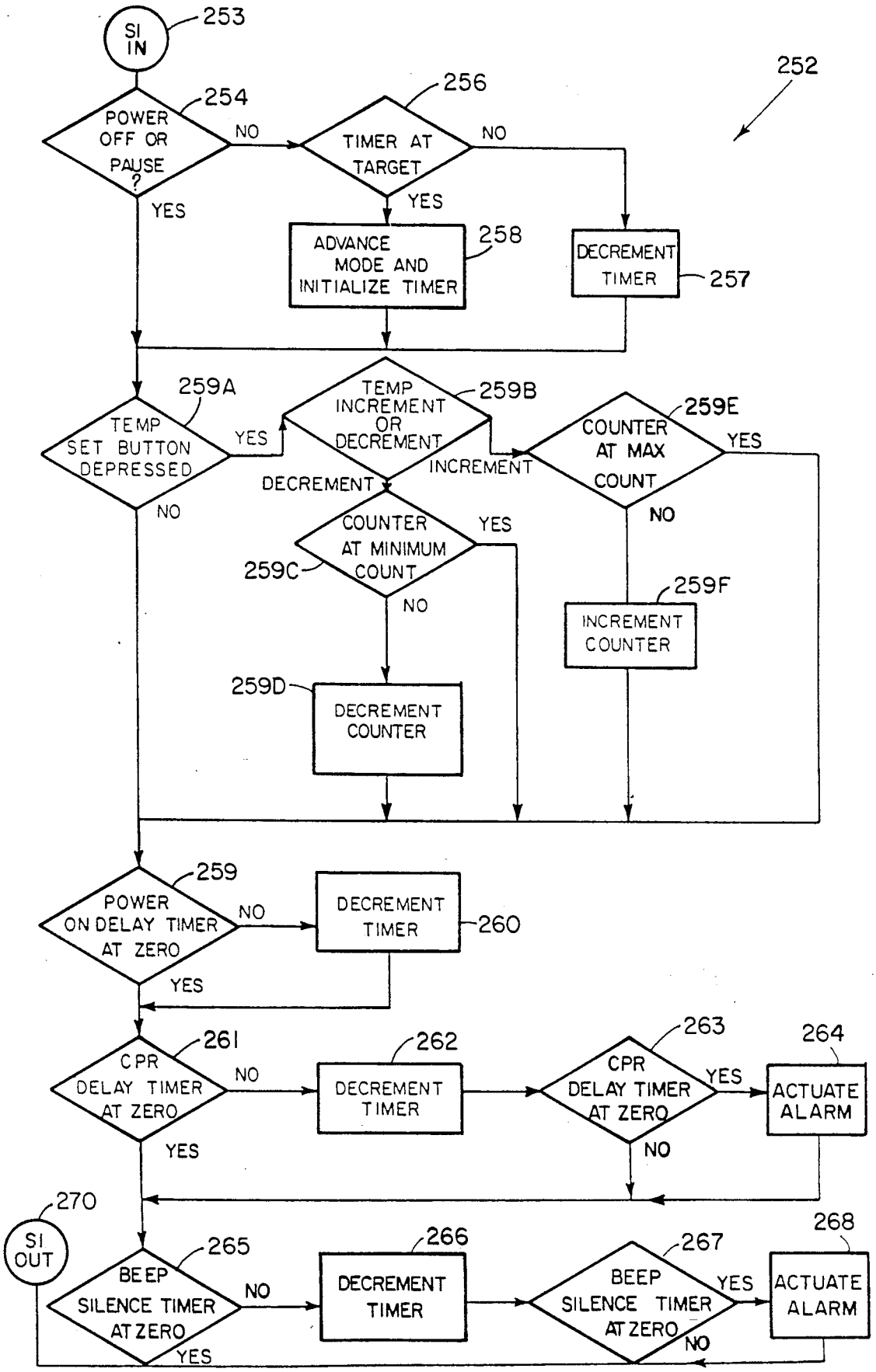
FIG. 14 is a flow chart of the general timer subroutine for controlling the operation of the patient support system of FIG. 1.

RAM data table 903 is a block of memory which is used to store variables needed by the control software. Those variables include software timers, status flags, switch status inputs, analog data inputs, baseline pressure values, and a target temperature value. Software timers are simply memory contents which are initialized with a specified value and then decremented every fifty milliseconds by general timer routine 252 (shown in more detail in FIG. 14). Switch status inputs are digital inputs received from control panel 346 or from various switches described elsewhere. The status of each of these switches is stored in RAM data table 903 so that spurious switch bounce conditions can be detected, as is described in greater detail below. Status flags are memory words used by the software to communicate to the software modules a certain status which affects how a software module is to operate. For example, a status flag is used to signify whether the air bags 58 in fluid connection with manifolds 76, 78, 80 and 82 or the air bags in fluid connection with manifolds 76', 78', 80' and 82', i.e., the air bags of the first or second sets of air bags 58, are to be inflated. Status flags can be changed by external inputs or by the timing out of certain software timers. Also, the target pressures and temperature, which the software attempts to maintain and is adjustable by operator input, are stored in RAM data table 903. Analog data, corresponding to values received from pressure and temperature transducers, are processed by microprocessor 240 and converted into status flags.

Upon receiving the aforementioned internal interrupt, the first module to be executed by microprocessor 240 is general timer routine 252. This routine decrements the various software timers and sets certain status flags which affect the operation of other modules when a timed out condition occurs. Next, switch processing routine 254 (see FIG. 15), which scans all the digital inputs, is executed. When a change is detected in a digital input, the appropriate switch function routine 284 is executed. As will be described below, those switch function routines activate the selected operation according to the specific switch input change detected.

After all the digital inputs have been scanned, inflation control routine 292 (FIG. 16) is executed. Inflation control routine 292 determines whether valves 128, 130*a* and 130*b*, 132*a* and 132*b*, or 134*a* and 134*b* need to be opened, closed, or maintained in their present position to maintain or increase or decrease the pressure in the first or second set of air bags 58. To make that decision, inflation control routine 292 relies on analog data from the pressure transducers, baseline pressure values, timer values and status flags which tell the routine which baseline pressure values to use. Inflation control routine 292 sets status flags which are then read by motor valve routine 316 (FIG. 17). Motor valve routine 316 actually controls the valve motors 138 according to the decisions made by inflation control routine 292. Those decisions are communicated to motor valve routine 316 by status flags.

Heater/blower control routine 905 retrieves present and target temperature values from analog data RAM data table 903, compares them, and either turns heater strip 172 on or off with a digital output. The last module to be executed as part of the internal interrupt driven loop is the display writer-driver routine 901. This routine retrieves data from RAM data table 903 which is to be output to control panel 346 (see FIG. 12). Display writer-driver routine 901 then drives the bar graph displays 356 of control panel 346 according to the data retrieved. Analog input routine 904 operates continuously according to external interrupts generated from the temperature and pressure transducers (shown collectively at reference numeral 900 in FIG. 19) by an analog-to-digital converter shown schematically at reference numeral 800, but which is internal to control box 198 and, therefore, not shown elsewhere. Analog input routine 904 retrieves data from analog-to-digital converter 800 for use by various software modules.

Figure 13:
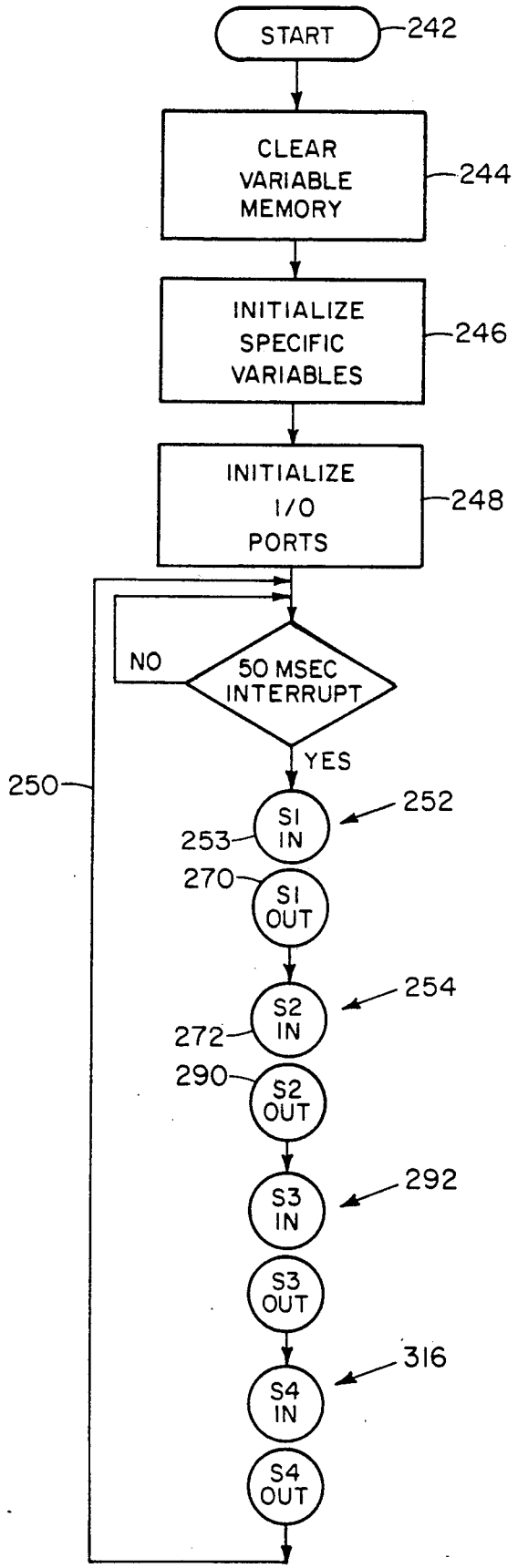
FIG. 13 is a flow chart of a presently preferred embodiment of the program for controlling the operations of the patient support system in FIG. 1 from the control panel shown in FIG. 12.

Referring now to FIGS. 13–18, the programming of microprocessor 240 will be discussed. As shown in FIG. 13, the initialization of the program is at 242. Variable memory or RAM is cleared at step 244. Before internal or external interrupts are enabled, all RAM variable contents are zeroed and those requiring specific data, such as those stored at power down in the electrically alterable ROM described below, are initialized at step 246. Data and direction registers for the four eight bit ports of microprocessor 240 are then initialized at step 248.

The control software then idles in loop 250 until it receives a 50 millisecond interrupt from the hardware interrupt timer internal to microprocessor 240. Microprocessor 240 then sequentially executes the subroutines 252, 254, 292 and 316, diagrammed in FIGS. 14–7. General timer subroutine 252 (see FIG. 14) decrements most of the software driven timers contained in the RAM, including the electrically alterable ROM power "ON" delay before erase timer, the cardiopulmonary switched "OFF" to the audible alarm "ON" delay timer, the audible alarm silence timer, and the rotation timer. General timer subroutine 252 is entered from FIG. 13 at connector 253, and the first step 255 is to test to determine whether the power on/off pushbutton 851 (see FIG. 12) has been switched to the "OFF" position or the run/pause adjust button 728 has been activated, a step which is required because the loop 250 runs at 50 msec intervals whenever main power cord 218 (see FIG. 10) is plugged into a power source (not shown). If either of those buttons 851 or 728 have been activated, the subroutine 252 continues to step 259A, if not, the status of the air pulsation timer is checked at step 256. The air pulsation timer is used to time the inflation/deflation of the air bags of the first and second sets of air bags 58 from the selected baseline pressures as will be described. If the target (zero) has not been attained, the air pulsation timer is decremented at step 257. If target has been attained, the pulsation mode is advanced to the next sequential pulsation phase and the timer is re-initialized at step 258.

As will be described, temperature set switch 152 is used in conjunction with display 168 on control panel 346 (see FIG. 12) to set the target temperature in air manifold feeding the bags by pressing and holding one or the other of switches 152A or 152B to increment or decrement the counter which advances the target temperature by an increment each time a selected number of 50 msec pulses have elapsed (or decreases by that same increment). If switch 152A or 152B has been activated by the operator, a test is made at step 259B to determine which switch was activated. If decrease/decrement switch 152B was activated, the counter is checked to determine whether the count is at minimum count at step 259C. If so, the subroutine advances to step 259, and if not, the counter is decremented at step 259D and the subroutine 252 continues to step 259. If the status check at step 259B indicates that the temperature increase/increment switch 152A has been activated, the counter is checked to determine whether the count is at a maximum at step 259E. If so, subroutine 252 advances to step 259, and if not, the counter is incremented at step 259F and subroutine 252 then advances to step 259.

If the power "ON" delay timer is not zero at step 259, that timer is decremented at 260, and the subroutine advances to step 261. The cardiopulmonary timer is decremented at step 262 if the timer is not zero, and checked again at step 263. If the timer has just expired and there is an alarm condition, the alarm (not shown) in microprocessor 240 is activated at 264; if the timer has not expired, the routine advances to the audible beep silence timer at 265. If that timer has not expired, the timer is decremented at 266, checked again at 267, and if just expired, the alarm is activated at 268. The general timer subroutine 252 is then exited when the last timer has been processed, and connects back into the control software at 270 (see FIG. 13).

Figure 15:
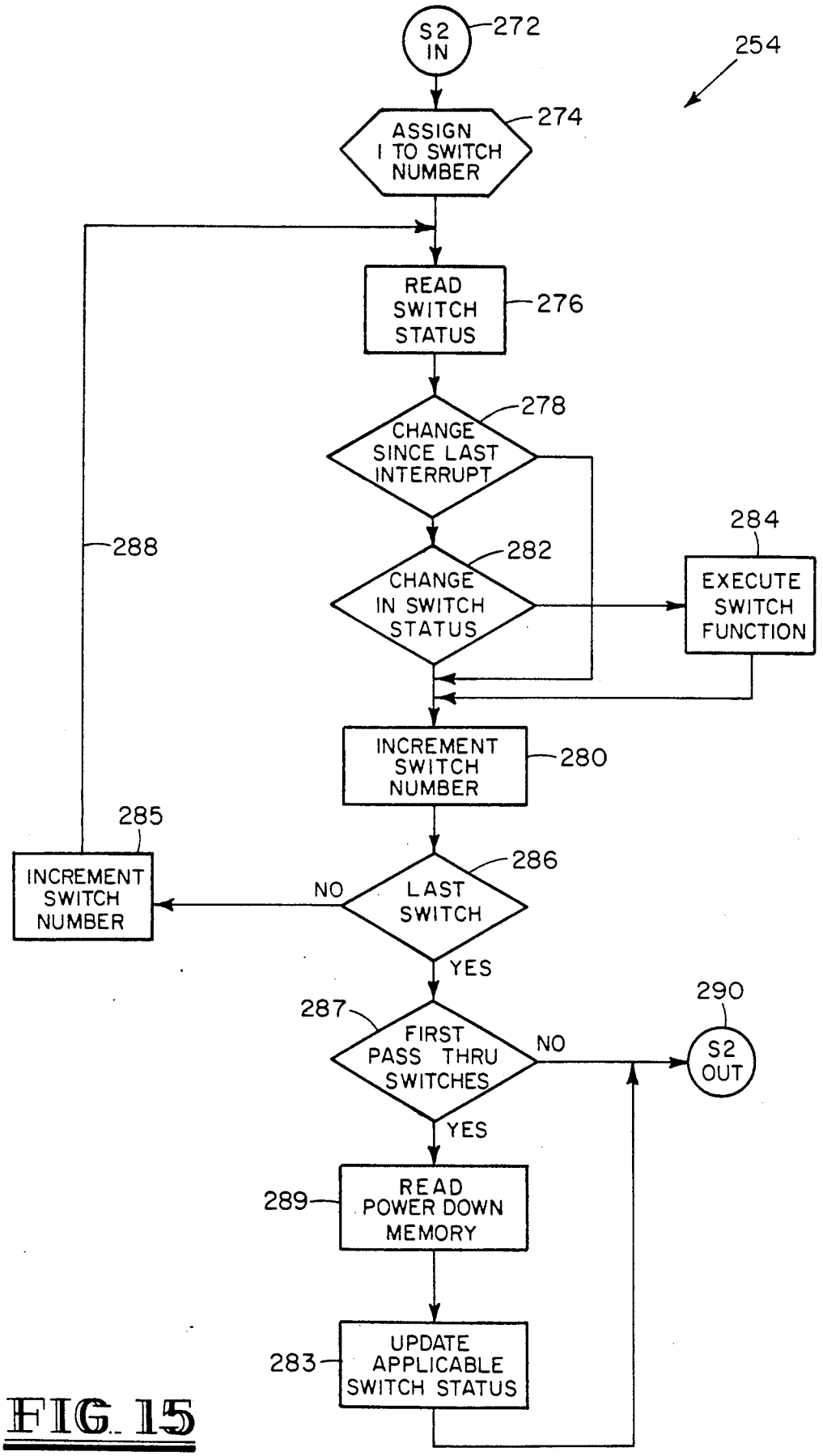
FIG. 15 is a flow chart of the switch processing subroutine for controlling the operation of the patient support system of FIG. 1.

The switch processing subroutine 254 is diagrammed in FIG. 15, and monitors the status of the switches on control panel 346, the switches 226 and 228 in air box 124, the status of the switches (not shown) of hand control 361 (see FIG. 12), and pressure sensor pad switches 231*a* and 231*b*. Switch processing subroutine 254, entered from FIG. 13 at connector 272, assigns a number to each input at step 274, and processes each numbered input in loop fashion. Each input is tested for status at 50 millisecond intervals at step 276, although it will be understood by those skilled in the art who have the benefit of this disclosure that other time intervals may likewise be appropriate for testing the status of the inputs. Switch status is tested by comparing the current switch status with the status of the switch from the last interrupt at step 278. If a change is detected, a switch bounce condition is assumed and the switch number is incremented at step 280 for processing the next switch input. If a change from the prior switch status is detected, a switch position change test is made at step 282 and switch function is executed at step 284 if a switch change is detected. If the switch status is consistent through three successive tests, no switch position change is indicated and the switch number is incremented at step 280 as described above. Switch number is compared to a limit number at step 286, and if less then that limit number, the switch number is incremented at 285 and the above processing is repeated in loop 288 for the incremented switch number. Provision is made to initialize the switch states on power up by testing at step 287 to determine whether the first pass is being made through the switches. If so, the power down memory is read at 289 and those toggle mode switches for which data is stored in the electrically alterable ROM are initialized at 283 to reflect the switch status at the time of the previous power off. Switch processing subroutine 254 is exited when the last switch number has been processed and connects back into the control software at 290.

Figure 12:
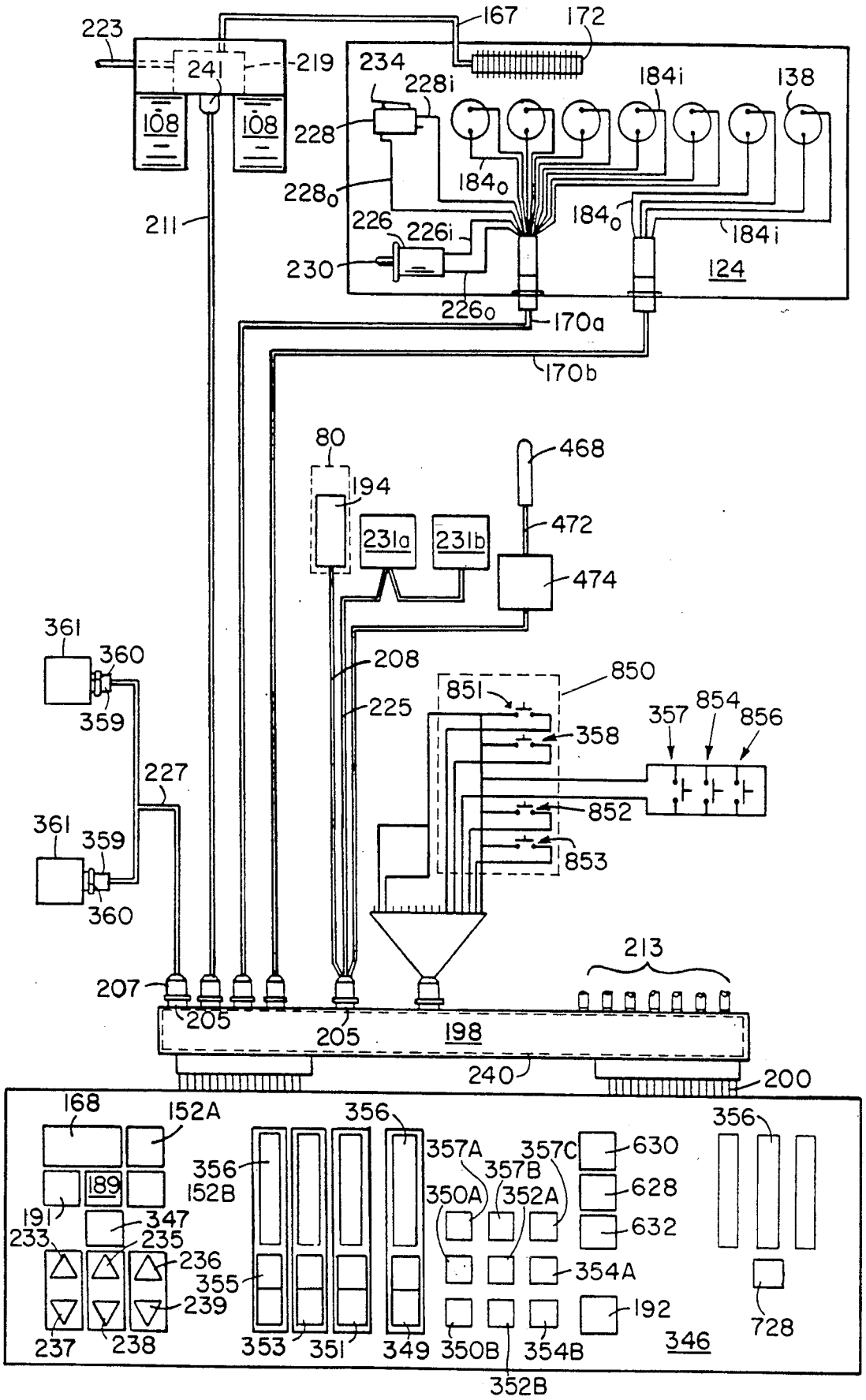
FIG. 12 is schematic diagram of the electrical cables and controls which open and close the valves to route air to the air bags of, the patient support system of FIG. 1.

There are separate switch function routines 284 for each functional set of operator inputs to control panel 346. Referring to FIG. 12, control panel 346 is provided with air adjust switches 349, 351, 353, and 355. Each air adjust switch 349, 351, 353, and 355 is actually a pair of buttons which raises or lowers the baseline or target pressure to be achieved in each set of air bags 58 by indirect adjustment of each of valves 128, 130*a* and 130*b*, 132*a* and 132*b*, 134*a* and 134*b* upon operator command. These target pressures are stored in memory locations by microprocessor 240. In the air pulsation subroutine described below, the baseline pressures are used as setpoints which the software attempts to achieve and/or maintain by opening and closing valves 128, 130*a* and 130*b*, 132*a* and 132*b*, 134*a* and 134*b*. There are four baseline pressures, one for each of the patient's head, shoulder, body and leg, and it is those four baseline pressures which are stored into memory, i.e., the RAM data table 903 (see FIG. 19) and which are attained if the power on switch 851 is activated without subsequent adjustment with the controls of control panel 346. Those baseline pressures are reflected in the bar graphs 356 immediately above each respective air adjust switch 349, 351, 353, and 355 for each portion of the patient's body. As will be explained, bar graphs 356 can be used to display actual pressure in air bags 58 during normal operation of patient support system 10 or to display baseline pressures during operator programming. On activation of the power on switch 851, each of the bar graphs 356 display the left and right averages of actual air pressures in the four sections of the patient's body above each corresponding pair of air adjust switches 349, 351, 353, and 355. To change a baseline pressure, the operator activates air adjust switch 630 and then uses the desired air adjust switch 349, 351, 353 or 355 to increase or decrease the baseline pressure that is to be changed. Switch function routine 284 (see FIG. 15) then increments or decrements the memory location in RAM which corresponds to that baseline pressure. At the same time, the changing baseline pressure is output to the bar graph 356 corresponding to the particular air adjust switch that has been activated. In this way, each of the four baseline pressures for the four portions of the patient's body is defined by the operator. The air adjust switch 630 is then depressed again to exit the air adjust mode.

Default settings are provided for three weight ranges of patients, each default setting having a tall and a short patient option. These default settings are preset baseline pressures likewise permanently programmed into memory locations in RAM table 903. Buttons are provided on control panel 346 for selection of these baseline pressures for tall patients in the light weight range 350A, for short patients in the light weight range 350B, for tall patients in the medium weight range 352A, for short patients in the medium weight range 352B, for tall patients in the heavy weight range 354A and short patients in the heavy weight range 354B. These "tall" and "short" designations are subjective and merely constitute a range of baseline pressures which can be selected based upon the subjective height and weight combination of the patient. In a presently preferred embodiment, the light, medium, and heavy patient weight guidelines correspond to patients weighing between 100 and 160, 150 and 210, and 200 and 250 pounds, but those skilled in the art who have the benefit of this disclosure will recognize that other guidelines may be equally appropriate. These guidelines were selected by determining the average baseline pressures needed to satisfactorily support the largest number of patients on air bags 58. The average baseline pressures were determined by experimentation involving a large number of persons on a patient support system such as that shown at reference numeral 10 of random height and weight, and recording the air pressure settings required to support each person satisfactorily. When grouped according to the above-described subjective height-weight combinations, the pressure settings fell into recurring patterns such that the use of the default settings provides for proper support of most patients, even when used by hospital personnel unfamiliar with the operation of a patient support system constructed in accordance with the present invention or the unique advantages of low air loss therapy.

Indicator lights 357A, 357B, and 357C are provided above each of the switches 350A and 350B, 352A and 352B, and 354A and 354B to provide an immediate indication of which range of patient weight and height has been selected by the operator. The bar graph 356 located immediately thereabove provides a display of the baseline target pressures resulting from selection of one of the switches 350A and 350B, 352A and 352B, or 354A and 354B. Further, air adjust switch 630 can be activated and baseline pressures adjusted in the same manner as described above. Switch 630 must be active for 350A, 350B, 352A, 352B, 354A, and 354B to work as well. Once the switch 350A or 350B, 352A or 352B, or 354A or 354B has been activated, and the adjusted baseline pressure is stored in RAM data table 903 the air adjust switch 630 is then depressed again to exit the air adjust mode.

Another switch function routine 284 similar to that described above allows the operator to adjust the pause time, i.e., the period of time during which the patient is supported by the air bags of either the first or second set of air bags 58. The pause time is stored in a timer location which the timer routine decrements after each interval interrupt. The pause time is adjusted by depressing the pause adjust button 728 and monitoring the bar graph 356 immediately above switch 728 on control panel 346.

Another switch function routine 284 is executed when the switch processing routine 254 detects an operator input from height adjust switches 233, 235, 236, 237, 238, and 239. Switches 233 and 237 raise and lower the frame section 14' of patient support system 10, respectively, while switches 236 and 239 raise or lower frame section 14'''', respectively. Switches 235 and 238 raise or lower the entire frame 12 of patient support system 10, respectively. The switch function routine which is executed when one of those switches is depressed causes actuation of the power screws described above to effect the appropriate height adjustment.

Similarly, another switch function routine 284 allows the operator to adjust the temperature at which the air supply to air manifolds is to be maintained. The target temperature is used as a setpoint by microprocessor 240 to control heater strip 172. The target temperature is adjusted using switches 152A and 152B, and a digital display 168 of the target temperature is driven by the software.

Figure 16:
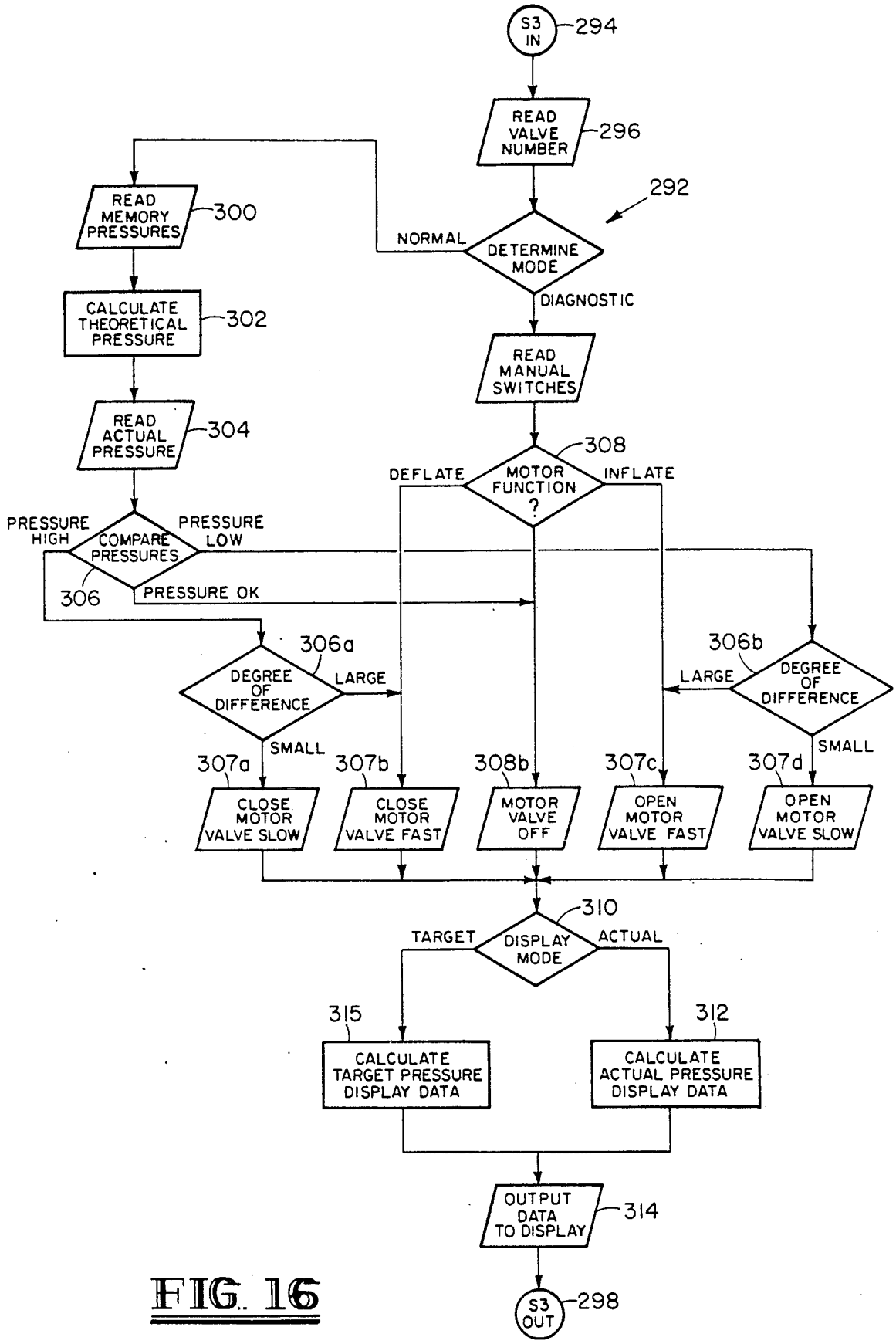
FIG. 16 is a flow chart of the air control subroutine for controlling the operation of the patient support system of FIG. 1.
Figure 17:
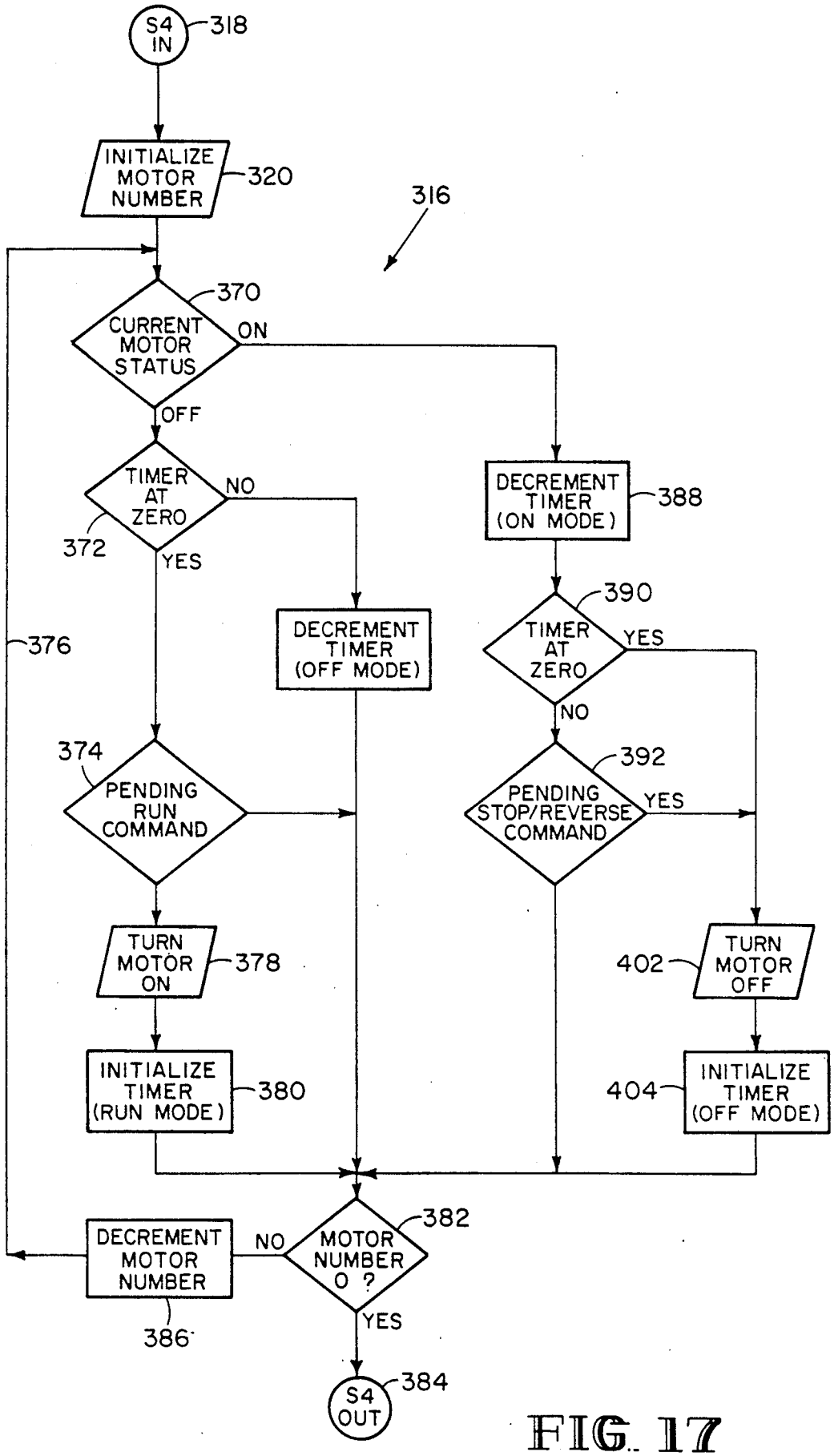
FIG. 17 is a flow chart of the valve motor driver subroutine for controlling the operation of the patient support system of FIG. 1.

The pulsation subroutine 292 is shown in FIG. 16. This routine is entered at connector 294 after general timer subroutine 252 has adjusted the appropriate software timers to determine the baseline pressure to which the patient support system is to be either altered or maintained. Subroutine 292 is then executed for each of valves 128, **130*a* and 130*b*, 132*a* and 132*b*, 134*a* and 134*b* to alternately inflate and deflate the two sets of air bags 58 supplied with air by manifolds 76, 78, 80, and 82 and 76', 78', 80' and 82' to alternately support the patient on either the first or second set of air bags 58. The particular valve number is read at step 296 and the operator mode checked to determine whether the normal or diagnostic mode (see below) has been selected at step 297. Next, the baseline pressure for that particular valve set as described above is read from RAM table 903 at step 300** and the resultant target pressure is then calculated dependent upon PULSE status and time into the cycle. Baseline values are used if PULSE is off.

Once pulse pushbutton 358 has been selected, controller 198 including microprocessor 240 therein operates to alternately signal valves 128, **130*a* and 130*b*, 132*a* and 132*b*, and 134*a* and 134*b* to increase the pressure in the first set of air bags 58 to a predetermined maximum pressure, decrease the pressure in the second set of air bags 58 to a predetermined minimum pressure, and then raise the pressure in the second set of air bags 58 to a predetermined maximum pressure and lower the pressure in the first set of air bags 58** to a predetermined minimum pressure.

| | Low Pulse | High Pulse |
|---|---|---|
| Maximum | +12.5% | +25% |
| Minimum | −25% | −50% |

Each number in the above table is a percentage of the baseline Pressure, i.e., if the low pulse switch 632 is selected, the maximum pressure is 12.5% above baseline pressure and the minimum pressure is 25% below baseline pressure. It will be understood by those skilled in the art who have the benefit of this disclosure that these percentages are a range of pressures which may vary depending upon the weight of the patient, the baseline pressure selected, whether one or both of blowers 108 is being operated, and a variety of other factors.

At step 302, theoretical pressure is calculated. Reference is made to theoretical pressures because of the active nature of the operation of the patient support system 10. Beginning with the baseline pressure, the deviation of target pressure from the baseline is calculated at this step, and that deviation will, of course, depend upon whether the air bags 58 under the control of a particular motor 138 are being inflated or deflated, i.e., whether the patient support system is being operated in the pulse mode, and time into the PULSE mode cycle. Consequently, theoretical pressure is baseline pressure if the patient support system 10 is not in the pulsation mode.

At step 307, an individual valve 128, **130*a* and 130*b*, 132*a* and 132*b*, or 134*a* and 134*b* may or may not be adjusted according to the output signal of potentiometer 468 which is also read at step 300. Potentiometer 468 inputs a voltage value to analog-to-digital converter 474 which converts that voltage to a digital value representing the angular displacement of a section 14' with respect to the adjacent section 14''. As the section 14' of frame 12 is pivoted with respect to the section 14'', the distribution of the weight of the body of the patient supported on the air bags 58 is changed. Accordingly, microprocessor 240** adjusts the target pressures to compensate for that change in weight distribution.

Referring to FIG. 11, two adjacent frame sections 14' and 14''are shown joined by hinge 44'. Bracket 462 is attached to frame section 14'' by bolt 464 and nut 466. Potentiometer 468 is mounted upon bracket 462 such that the shaft 467 thereof is free to rotate throughout an appropriate operating range. The shaft 467 of potentiometer 468 and hinge 44' are arranged so that their axes of rotation are aligned, and the shaft 467 of potentiometer 468 is journaled in frame section 14'. When frame section 14'' is pivoted with respect to section 14', connector 470 is likewise rotated, causing the rotation of the shaft 467 of potentiometer 468, resulting in a change in the output voltage of potentiometer 468 which is proportional to the angular displacement between frame sections 14' and 14''. That change in output results in a signal which is transmitted by wire 472 to microprocessor 240 (see FIG. 12). The output signal of potentiometer 468 is adjusted so that for each increment in the elevation of frame section 14' from the horizontal of about 15°, the pressure in the sets of air sacs mounted on baseboards 48 and 50 is increased by.

An actual pressure is obtained by sensing the air pressure in the air chuck 212 (see FIGS. 8, 9A, and 9B) corresponding to the particular valve 128, 130*a* and 130*b*, 132*a* and 132*b*, or 134*a* and 134*b*, which is at, or close enough to the air pressure in the air bags 58 which are inflated or deflated by opening or closing that valve to provide an air pressure measurement that can be compared to the theoretical pressure to allow any necessary adjustment as described below. The pressure from air chucks 212 is transmitted by air pressure lines 213 to pressure transducers (not shown) mounted in control box 198. The pressure transducers are of a type suitable for reading pressures in the range of about 0–1 psig available Microswitch Corp. (Freeport, Illinois) and Sensym Corp. (Sunnyvale, Calif.). The pressure transducers output a voltage proportional to the particular pressure to an analog-to-digital converter within control box 198 which then inputs data to microprocessor 240.

Once the theoretical pressures have been calculated and the actual pressures read, the two pressures are compared at step 306. If the actual pressure is too high, the degree of difference is determined at step 306*a*, and if the degree of difference is small, the opening 202 of that valve is closed by activating the motor to run slowly at step 307*a*. If the degree of difference is large, the opening 202 of that valve is closed by activating the motor 138 to run quickly at step 307*b*. If the actual pressure is too low at step 306, the degree of difference is determined at step 306*b*. If the degree of difference is small, the motor 138 is activated to open the opening 202 of that valve slowly at step 307*d*, and if the degree of difference is large, the motor 138 is activated to open the opening 202 of that valve quickly in step 307*c*. If the theoretical and actual pressures for that set of air bags 58 are equal, the valve motor 138 of the valve corresponding to that set of air bags 58 is turned off at step 308*b*.

After execution of step 308*b*, provision is made for display of the actual air pressure in the air chucks 212 in fluid connection with the couplers 153 of each of the valves 138, 130*a* and 130*b*, 132*a* and 132*b*, and 134*a* and 134*b* on bar graphs 356. The operator selects whether actual or target pressures are displayed at step 310 by whether air adjust switch 630 (see FIG. 12) has been actuated. Actual display data is calculated at step 312 and output to bar graphs 356 at step 314. If switch 630 has been actuated, target display data is calculated at step 315 and output at 314 as before. Pulsation subroutine 292 is then exited at connector 298. Left and right pressures are averaged for the display.

Pulsation subroutine 292 is also provided with a diagnostic mode entered by key stroke sequence available to qualified personnel. In the diagnostic mode, the valve motors 138 do not run on their own; instead, they are immediately turned off and pressures are allowed to drift. The individual air adjust switches 349, 351, 353, and 355 can then be used to manually open or close a particular valve 138, 130*a* and 130*b*, 132*a* and 132*b*, and 134*a* and 134*b*. Those switches are read at step 305 and the appropriate motor function executed at step 308. If the deflate switch has been activated, motor 138 is activated to close the valve quickly at step 307*b*. If the inflate switch has been activated, the motor 138 is activated to open the valve quickly at step 307*c*. If no switches have been activated, the motor 138 remains off at step 308*b*. The air pressure is then displayed as discussed above.

Referring to FIGS. 1 and 12, pushbutton switches 851, 357, 358, 852, and 853 are mounted in auxiliary control Panel 850. Pushbutton 851 is the main power on/off switch. Depressing pushbutton 358 puts the patient support system 10 in the pulsation mode whereby microprocessor 240 directs the inflation/deflation of air bags 58 cyclically above and below the previously programmed baseline pressures to the programmed maximum or minimum pressures stored in RAM data table 903. Activating pushbutton 358 a second time places the patient support system 10 in the air suspension therapy mode and returns the air bags 58 to baseline pressure values. Pushbuttons 52 and 53 duplicate the function of switches 628 and 632 on control panel 346 as described above. Activating pushbutton 357 causes the air in the air bags 58 of both the first and second sets of air bags mounted to leg and seat baseboards 48 and 50, in other words, the air bags 58 which are supplied with air manifolds 78, 78', 80 and 80', to deflate rapidly. Deflation of those air bags 58 facilitates the transfer of a patient, or the movement of the patient under the patient's own power, onto or off of patient support system 10. The function of pushbutton 357 is duplicated by pushbutton switches 854 and 856, shown schematically in FIG. 12, and located on the sides of the frame 12 of patient support system 10.

The valve motor subroutine 316, diagrammed in FIG. 17, converts valve motor movement commands generated by the switch processing and pulsation subroutines 254 and 292, respectively, into valve motor operations, i.e., starting and reversing each of the motors 138 used to open and/or close valves 128, 130*a* and 130*b*, 132*a* and 132*b*, and 134*a* and 134*b*. Each motor 138 is provided with a timer (not shown), and is pulsed on and off under control of that timer, which is in turn controlled by valve motor subroutine 316. Valve motor subroutine 316 is entered at connector 318. Each motor 138 is assigned a number at step 320 and is tested for its current status, i.e., on or off, at step 370. If the current motor status is off, the timer is checked to determine whether the counter has counted down to zero at step 372. If the timer has timed out, then the software can turn the motor back on, and in the next step 374, the software is checked to determine whether there is a pending run command. If there is no pending run command, as would be the case if the air pressures in the respective air bags 58 are at the determined target pressures, the routine is exited by checking the motor number to determine whether all the motors 138 have been checked at step 382. If the last motor number has not been reached, the motor number is decremented at step 386 and the motor status of the next motor is checked at step 370 by operation of loop 376. If there is a pending run command at step 374 as a result of a difference in actual and theoretical pressure, valve motor subroutine 316 turns the motor 138 that supplies air to that particular set of air bags 58 on at step 378 and re-initializes the timer for that motor at step 380. The motor number is then checked to determine whether that motor was the last motor at step 382; if so, valve motor subroutine 316 is exited through connected 384, and if not, the motor number counter is decremented at step 386 and processing continues by way of loop 376.

If a motor is on at step 370, the valve motor subroutine 316 continues by decrementing the RUN mode timer at step 388. The timer is then tested to determine whether the counter has reached zero at step 390. If not, a test is made at step 392 to determine whether there are any pending stop or reverse commands. If not, the motor number is tested at step 382 to determine whether the last motor has been reached and processing continues as described above. If the counter has decremented to zero at step 390, that motor is turned off at step 402, the timer is initialized at step 404, and the number assigned to that motor is tested at step 382 to determine whether that motor number is the number of the last motor 138. If that number is not the last motor number, the motor number counter is decremented at step 386 and the above processing repeated.

Figure 18:
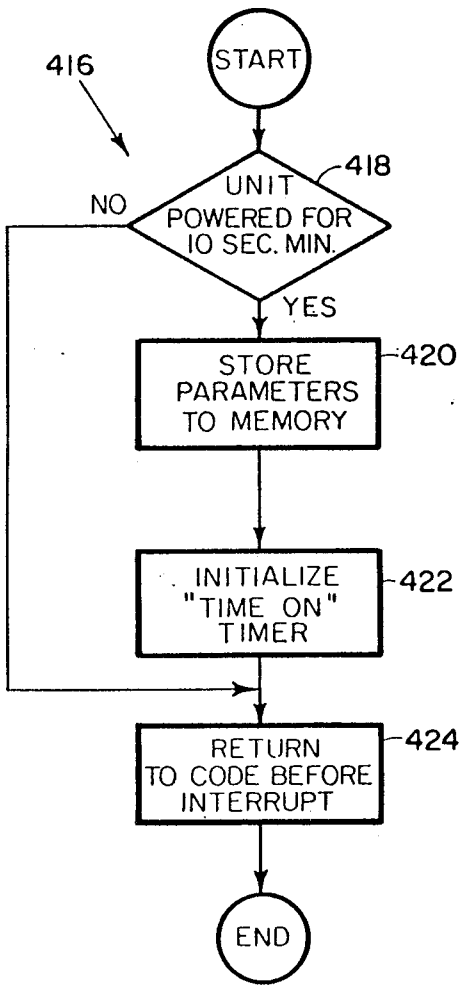
FIG. 18 is a flow chart of the power fail interrupt subroutine for controlling the operation of the patient support system FIG. 1.

A power fail interrupt subroutine 416, diagrammed in FIG. 18, writes certain controller configuration parameters such as blower and pulsation mode status in electrically alterable ROM in the event of a power failure or when patient support system 10 is unplugged. Power fail interrupt subroutine 416 is entered upon receipt of an interrupt from hardware circuit not shown. If the electrically alterable ROM, power on delay before erase, timer (EEROM timer) tested at step 418 is zeroed, i.e., if patient support system 10 has been powered on for more than a few seconds such that the electrically alterable ROM is available for writing, the aforementioned parameters are stored to memory at step 420 and the EEROM timer is initiated at step 422 before returning to the codes before the interrupt at step 424. If the EEROM timer is not zeroed at step 418, patient support system 10 has probably just been powered on and the memory is not available for writing. Should the control software (see FIG. 13) receive a power interruption that generates the power fail interrupt and performs the memory write but does not actually interrupt power to the control software, power fail interrupt subroutine 416 initializes the EEROM timer and will be available to rewrite the memory after the EEROM timer has once again timed out.

As noted above, the frame 12 is hinged at 44', 44'' and 44'40 ', allowing the baseboards 46 and 52 to be raised from the horizontal, changing the angle of inclination for the comfort of the patient or for therapeutic purposes. However, especially when head baseboard 52 is raised, the deviation from the horizontal places a disproportionate amount of the weight of the patient on the air bags 58 over the legs 48 and seat 50 baseboards. In a presently preferred embodiment of the present invention, there are only three air bags 58 mounted on each of the baseboards 48 and 50, such that a great proportion of the patient's weight, which is spread out over more than 20 of the air bags 58 when the sections 14', 14'', 14''' and 14'''' are all in the same horizontal plane, is concentrated onto as few as six of the air bags 58, and then that weight is concentrated onto even fewer air bags 58 when the air bags of the first and second sets of air bags are alternately inflated and deflated. Pressure sensor pad switches 231*a* and 231*b* (see FIG. 12) are placed flat on legs baseboard 48 and seat baseboard 50 so that, in the event a portion of the patient's body contacts either one of those switches 231*a* or 231*b*, the above-described audible alarm is activated by microprocessor 240, and can be silenced by activation of switch 347 by the operator, and the air pressure in air bags 58 mounted to seat baseboard 50 can be raised by the operator. This alarm is disabled during the CPR and seat deflate modes.

Figure 10:
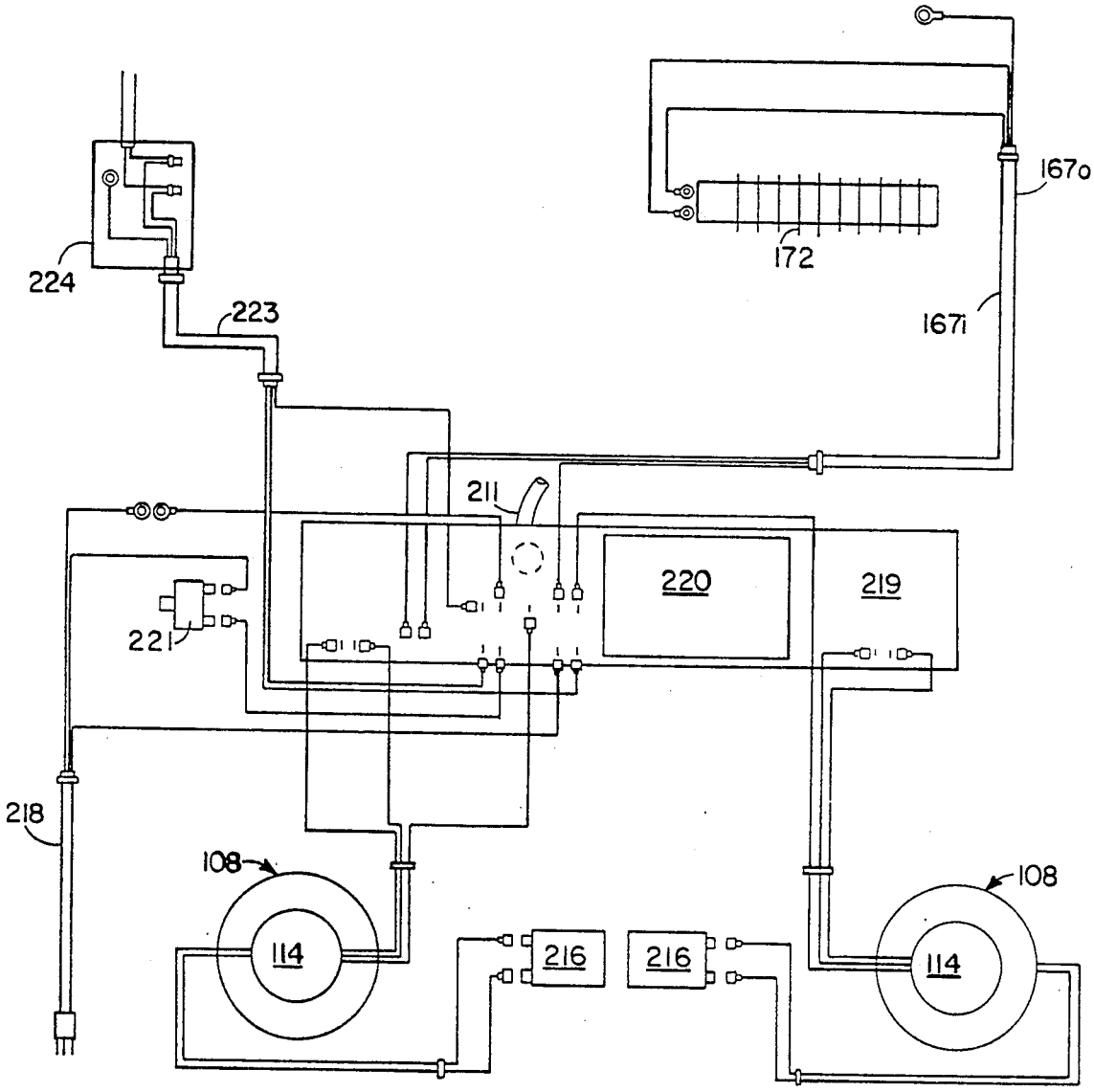
FIG. 10 is a schematic electrical diagram of the patient support system of FIG. 1.

Referring to FIG. 10, there is shown a schematic electrical diagram of a patient support system constructed according to the teachings of the present invention. Alternating current enters the circuitry in electric cord 218 which is connected to power distribution board 219 (see also FIG. 12). Power distribution board 219 includes a power supply module, shown schematically at reference numeral 220, to supply power to microprocessor 240 through cable 211 and solid state relays (not numbered) to control each of the blowers 108 and heater strip 172. Power distribution board 219 also provides power to the motors (not shown) within boxes 45 (see FIG. 7) for raising, lowering and positioning the frame 12 of patient support system 10 by means of lead 223 which connects to the junction box 224 of bed circuitry 43. Power distribution board 219 also powers the electric motors 114 of blowers 108. Each of the blowers 108 is provided with a capacitor 216. Blowers are indirectly controlled by switch 192 and other status inputs which are read by microprocessor 240. The cable connecting microprocessor 240 and switch 241 is buried in the cable 211 shown in FIG. 12.

Referring to FIG. 12, a temperature sensor, shown schematically at 194, is located in seat manifold 80 (also shown schematically). When the target temperature set by the operator using switches 152A or 152B and display 168 is more than the temperature of the air in seat manifold 80, heating strip 172 (shown schematically in FIG. 12) is switched on by microprocessor 240, again through the connection provided by a cable buried in cable 211. Heating strip 172 is provided with current by wires 167*i* and 167*o* from main power supply module 220 (see also FIG. 10). Switch 191 on control Panel 346 is used to activate or deactivate heating strip 172, and a separate switch 189 is provided for switching display 168 from ° C to ° F The microprocessor turns the heat off when both blowers are off.

As described above, limit switches 226 and 228 are provided in manifold plate 145 and on full inflate plate 144, respectively (see FIGS. 8, 9A and 12). Limit switch 226 is closed when push button 230 is engaged by dump Plate 150 (not shown in FIG. 12). When push button 230 is disengaged by the movement of dump plate 150 away from manifold plate 145 under the influence of levers 165, the circuit is opened and blowers 108 are shut off. As described above, limit switch 228 is affixed to full inflate plate 144 by screws 232, and the circuit including limit switch 228 and formed by wires 228*i* and 228*o* is open when lever arm 234 engages manifold plate 145. When full inflate plate 144 is opened under the influence of full inflate knobs 193, limit switch 228 is closed, activating both blowers 108, if not already on and the audible alarm which is incorporated into microprocessor 240. A switch 347 is provided on control panel 346 to silence that alarm.

Control panel 346 is connected to controller 198 by ribbon connectors 200. Controller 198 is provided with plug-type receptors 205 for receiving the plugs 207 of cables 170*a* and *b*, 208, 211, 225, 227, and 472.

Cable 208 connects controller 198 to temperature sensor 94. Cable 225 connects pressure sensor pad switches 231*a* and *b* to controller 198. Cables 170*a* and 170*b*are provided with separate wires 184*i* and 184*o* for each motor 138, thereby conducting low voltage D.C. current to each of the motors 138 under the control of microprocessor 240. Cable 170*a* is also provided with separate wires 226*i* and 226*o* and 228*i* and 228*o* connecting separately to limit switches 226 and 228*i* respectively.

Cable 227 is provided with plugs 359 on the other end from plug 207 for engaging a complementary plug 360 on a separate hand control 361 which duplicates the function of the switches 233, 235, 236, 237, 238, and 239 on control panel 346. Hand controls 361 are shown schematically in FIG. 12 because they merely duplicate keyboard 346 functions. Plugs 359 are provided on both sides of bed frame 12 (not shown in FIG. 12) to facilitate easy access by hospital personnel with hand control 361.

Although the present invention has been described in terms of the foregoing preferred embodiments, this description has been provided by way of explanation only and is not to be construed as a limitation of the invention, the scope of which is limited only by the following claims.

What is claimed is:

1. An alternating pressure low air loss bed comprising:

a first and second sets of interdigitated air bags collectively forming a patient supporting surface said air bags being transversely oriented relative to a longitudinal axis of said patient supporting surface;

a pressurized air source for inflating said air bags;

means for separately maintaining the air pressure within the first and second sets of air bags at a predetermined baseline pressure value; and means for repetitively, and in opposite phase, raising and lowering the pressure within the first and second sets of air bags to predetermined maximum and minimum pressure values above and below the baseline value, respectively.

2. The bed as set forth in claim 1 wherein:

the patient supporting surface is divided into a plurality of groups, each of said groups corresponding to a different body region of a patient supported thereon; and the air bags belonging to each group are maintained by a controlling means at separate predetermined baseline pressure values.

3. The bed as set forth in claim 2 further comprising a frame for mounting the air bags having a plurality of sections, each of said sections being pivotable with respect to the others of said sections for adjusting the attitude of a patient lying on the supporting surface.

4. The bed as set forth in claim 3 wherein each group of air bags is mounted on a frame section and further comprising:

means for sensing the extent to which one frame section is pivoted with respect to another; and means for adjusting the baseline pressure values in accordance with information obtained by the pivot sensing means.

5. The bed as set forth in claim 2 wherein both the pressure maintaining means and the pressure raising and lowering means comprise:

an air box for receiving air from the air source;

a plurality of air manifolds, each manifold being fluidly connected to the air box and to one of each set belonging to each group of air bags for supplying air thereto;

a plurality of electrically variable valves for separately controlling the air flow between the air box and each air manifold; and means for sensing the air pressure downstream from each valve.

6. An alternating pressure low air loss bed comprising:

a frame having a plurality of sections pivotable with respect to each other, each section corresponding to a portion of the body of a patient supported thereon;

first and second sets of air bags mounted transversely to each of the sections of said frame, the air bags of said first set of air bags alternately mounted between the air bags of said second set of air bags on each section of said frame;

means for supplying air from an air source to said air bags;

means for separately sensing the pressure in the air bags of each of said first and second sets of air bags mounted to each section of said frame;

means for separately maintaining a selectable baseline pressure in the air bags mounted to each section of said frame;

means for alternately signalling said air supplying means to increase the pressure in said first set of air bags to a predetermined and selectable maximum pressure, above the baseline value, decrease the pressure in said second set of air bags to a predetermined and selectable minimum pressure below the baseline value and then to raise the pressure in said second set of air bags to said maximum pressure and lower the pressure in said first set of air bags to said minimum pressure.

7. The bed as set forth in claim 6 further comprising means for changing the pressure in the air bags of each of said first and second sets of air bags mounted to each section of said frame when the sections of said fame are pivoted with respect to each other.

8. The bed as set forth in claim 7 wherein said pressure changing means comprises a potentiometer mounted to one section of said frame and having means mounted thereto which engages an adjacent section of said frame so that pivoting the sections of said frame causes a change in the output signal of said potentiometer.

9. The bed as set forth in claim 6 wherein at least one air bag of each of said first and second sets of air bags is mounted to each section of said frame.

10. The bed as set forth in claim 6 wherein said air supplying means comprises an air box for receiving air from a blower and having a plurality of openings therein connected to a plurality of air supply hoses, each of the air supply hoses being separately connected to a manifold in fluid connection with the air bags of each of the first and second sets of air bags mounted to each section of the frame.

11. The bed as set forth in claim 10 wherein each of the openings in said air box is provided with an electrically controlled valve for increasing and decreasing the amount of air flowing therethrough to increase and decrease the air pressure in the air bags.

12. A method for alternating the points at which the pressure of the air bags of a low air loss patient support system exert pressure against the skin of a patient supported thereon comprising:

supporting a patient on first and second sets of air bags mounted to sections of a bed frame, the air bags of the first set o air bags being mounted transversely to each section of the frame interdigitated between the air bags of the second set of air bags;

maintaining a baseline pressure int eh air bags of the first and second sets of air bags mounted to each section of the frame; and repetitively, and out of phase, changing the pressures in each of the first and second sets of air bags to selected maximum and minimum values above and below the baseline pressure of the air bags mounted to each section of said frame so as to alternate the pressure points to which a supported patient is subjected.

13. An alternating pressure low air loss patient support for inhibiting formation of bed sores and circulatory complications, comprising:

first and second sets of interdigitated low air loss air bags collectively forming a patient supporting surface, said air bags being transversely oriented relative to a longitudinal axis of said patient supporting surface;

a pressurized air source for inflating the air bags;

means for separately maintaining the air pressure within the first and second sets of air bags at a predetermined baseline pressure value at which uniformity of support is sufficiently maximized to avoid capillary collapse in a patient supported thereon; and means for repetitively, and in opposite phase, raising and lowering the pressure within the first and second sets of air bags to predetermined maximum and minimum pressure values above and below the baseline value, respectively, in a manner which alternately changes the location at which pressure is exerted against the patient.

14. The alternating pressure low air loss patient support of claim 13, wherein:

the patient supporting surface is divided into a plurality of groups, each of said groups corresponding to a different body region of a patient supported thereon; and the air bags belonging to each of said groups are maintained by said maintaining means at separate predetermined baseline pressure values.

15. The alternating pressure low air loss patient support of claim 13, wherein:

each of said air bags has a substantially rectangular vertical cross section and has opposed, substantially vertical end walls which are vertically elongated.

16. The alternating pressure low air loss patient support of claim 13, wherein:

each of said air bags has an upper surface for supporting the patient thereon, and the upper surface of each of said air bags is independent from the upper surface of an adjacent air bag for minimizing tension in the top surfaces of said air bags in order to minimize the pressure exerted by said air bags against a patient supported thereon and, thereby, help to inhibit formation of bed sores and circulatory complications in the patient.

17. An alternating pressure low air loss patient support for inhibiting formation of bed sores and circulatory complications, comprising:

first and second sets of interdigitated low air loss air bags collectively forming a patient supporting surface, said air bags being transversely oriented relative to a longitudinal axis of said patient supporting surface, said supporting surface being divided into a plurality of groups, each of said groups corresponding to a different body region of a patient supported thereon;

each of said low air loss air bags having:

a substantially rectangular vertical cross section, opposed, substantially vertical end walls which are vertically elongated, and an upper surface, composed of a water vapor permeable fabric, for supporting the patient thereon, the upper surface of each of said low air loss air bags being independent from the upper surface of an adjacent air bag for minimizing tension in the top surfaces of said low air loss air bags in order to minimize the pressure exerted by said low air loss air bags against a patient supported thereon and, thereby, help to inhibit formation of bed sores and circulatory complications in the patient;

a pressurized air source for inflating the air bags;

means for separately maintaining the air pressure within the first and second sets of air bags at predetermined baseline pressure values, the air bags belonging to each of said groups being maintained at separate predetermined baseline pressure values at which uniformity of support is sufficiently maximized to avoid capillary collapse in the body region of the patient supported thereon; and means for repetitively, and in opposite phase, raising and lowering the pressure within the first and second sets of air bags to predetermined maximum and minimum pressure values above and below the baseline value, respectively, in a manner which alternately change the locations at which pressure is exerted against the patient.

18. The alternating pressure low air loss patient support of claim 17, further comprising:

a frame for mounting the air bags, said frame having a plurality of sections, each of said sections being pivotable with respect to the others of said sections for adjusting the attitude of a patient lying on the supporting surface.

19. The alternating pressure low air loss patient support of claim 18, further comprising:

means for sensing the extent to which one frame section is pivoted with respect to another; and means for adjusting the baseline pressure values in accordance with information obtained by the pivot sensing means.

20. An alternating pressure air support system for inhibiting formation of bed sores and other circulatory complications in a patient supported thereon, comprising:

first and second sets of air bags collectively forming a patient supporting surface, said air bags being transversely oriented relative to a longitudinal axis of said patient supporting surface and said second set of air bags being disposed alternately between the first set of air bags;

a source of pressurized gas for inflating said air bags; and control means for controlling the inflation of said air bags, said control means maintaining inflation of each of the first and second sets of air bags at a baseline pressure when operating in a first mode, and said control means alternating the pressure within the first and second sets of air bags out of phase between predetermined maximum and minimum pressures above and below the baseline pressure, respectively, when operating in a second mode.

21. The alternating pressure air support system of claim 20, wherein:

said air bags comprise a plurality of low air loss air bags; and said control means comprises:

an air box for receiving air from the gas source;

a plurality of air manifolds, each manifold being fluidly connected to the air box and to one of each set belonging to each group of air bags for supplying air thereto;

a plurality of electrically variable valves for separately controlling the air flow between the air box and each air manifold; and means for sensing the air pressure downstream from each valve.

22. The alternating pressure air support system of claim 20, wherein:

the value of the maximum pressure of the second mode of operation of said control means is related to the baseline pressure.

23. The alternating pressure air support system of claim 20, wherein:

the value of the minimum pressure of the second mode of operation of said control means is positive and is related to the baseline pressure.

24. The alternating pressure air support system of claim 23, further comprising:

means for changing the baseline pressure at which said control means maintains the first and second sets of air bags in the first mode, said changing means changing the baseline pressure in relation to changes in the configuration of a frame supporting the patient supporting surface.

25. The alternating pressure air support system of claim 20, further comprising:

means for sensing the pressure in the air bags and transmitting signals to said control means which are indicative of the sensed pressure.

26. The alternating pressure air support system of claim 25, wherein:

said control means adjusts its operation in response to the signals transmitted by said sensing means.

27. The alternating pressure air support system of claim 20, further comprising:

means for selectively altering the operation of said control means between a plurality of modes.

28. The alternating pressure air support system of claim 20 wherein said control means further comprises:

means for selectively interrupting the second mode of operation of said control means.

29. The alternating pressure air support system of claim 28 wherein:

said interrupting means, when selectively actuated, maintains a pressure differential between the interiors of the first and second sets of air bags at any stage in the second mode of operation of said control means.

30. An alternating pressure low air loss support system for inhibiting circulatory complications in a patient supported thereon, comprising:

first and second sets of low air loss air bags collectively forming a patient supporting surface, said air bags being transversely oriented relative to a longitudinal axis of said patient supporting surface and said second set of air bags being disposed alternately between the first set of air bags;

a source of pressurized gas for inflating the air bags;

valve means for regulating a flow of gas from said pressurized gas source to separately regulate the pressure in the respective first and second sets of air bags;

means for sensing the pressure downstream of said valve means;

control means for controlling said valve means, said control means maintaining inflation of each of the first and second sets of air bags in a baseline pressure when operating at a first mode, and said control means alternating the pressure within the first and second sets of air bags in opposite phase between maximum and minimum pressures above and below the baseline pressure, respectively, when operating in a second mode;

said sensing means being adapted to transmit signals indicative of the pressure sensed by said sensing means to said control means;

said control means including means for selectively changing the baseline pressure in response to signals received from a control panel;

said control means achieving the alternating pressure within the first and second set of air bags when in the second mode by determining from differences between a theoretical pressure and the signal from said sensing means and adjusting said valve means to increase or decrease the flow of gas to the air bags to compensate for differences between the actual pressure and the theoretical pressure;

the value of the maximum pressure of the second mode of operation of said control means being related to the value of the baseline pressure, and the value of the minimum pressure of the second mode of operation of said control means being positive and related to the value of the baseline pressure; and means for selectively switching the operation of said control means from one of the first and second modes to the other.

31. An alternating pressure air support system for inhibiting formation of bed sores and circulatory complications in a patient supported thereon, comprising:

first and second sets of air bags collectively forming a reconfigurable patient supporting surface, said air bags being transversely oriented relative to a longitudinal axis of said patient supporting surface and said second set of air bags being disposed alternately between the first set of air bags;

a source of pressurized gas for inflating the air bags;

means for separately sensing the pressure in the air bags of each of said first and second sets of air bags;

control means for controlling the inflation of the air bags, said control means maintaining inflation of each of the first and second sets of air bags at a baseline pressure when operating in a first mode, and said control means alternating the pressure within the first and second sets of air bags out of phase between predetermined maximum and minimum pressures above and below said baseline pressure, respectively, when operating in a second mode; and means for signalling said control means to change said baseline pressure in response to changes in the configuration of said patient supporting surface.

32. The alternating pressure air support system of claim 31, wherein:

said patient supporting surface is mounted to a frame having one section articulatable relative to a second section;

said control means comprises first and second electrically adjustable valve means which separately regulate flows of gas from said source to a first group and a second group of said air bags, respectively, said first group being mounted to the first section of said frame and said second group being mounted to the second section of said frame; and said signalling means comprises a transducer which sends an electrical signal to said control means, which electrical signal is varied in response to changes in the articulation of the first section of said frame relative to the second section thereof.

33. A method of controlling a plurality of air bags in a manner which inhibits circulatory complications in a patient supported thereon by changing the location at which pressure is exerted against the patient, comprising the steps of:

inflating a first and a second set of air bags to a baseline pressure to support a patient thereon, the second set of air bags being disposed alternately between the first set of air bags; and repetitively, and in opposite phase, increasing and decreasing the pressure within the first and second sets of air bags to predetermined maximum and minimum pressures above and below the baseline pressure, respectively.

34. The method of claim 33 wherein the value of the minimum pressure is a percentage of the value of the baseline pressure, further comprising the step of adjusting the baseline pressure in a manner which is in relation to the angular displacement between different sections of a frame supporting said patient supporting surface.

35. The method of claim 33 wherein:

the difference between the baseline pressure and the predetermined minimum pressure is twice as great as the difference between the predetermined maximum pressure and the baseline pressure.

36. The method of claim 35 wherein the predetermined maximum pressure is in the range from 12.5% to and including 25% greater than the baseline pressure.

37. The method of claim 33 wherein:

the predetermined minimum pressure is in the range from 25% to 50% less than the baseline pressure.

38. The method of claim 33, further comprising the step of:

maintaining the pressure differential between the first and second sets of air bags for a predetermined period of time when the pressure in one of the first and second sets is raised to the maximum pressure and the pressure in the other of the first and second sets is lowered to the minimum pressure.

39. The method of claim 33 wherein said increasing and decreasing step further comprises:

determining the difference between a theoretical pressure and an actual pressure; and opening or closing a valve to a degree to compensate for said difference.

40. The method of claim 39, further comprising the steps of:

determining the theoretical pressure based on the baseline pressure, the maximum pressure and the minimum pressure; and sensing the pressure in a line downstream of said valve; and determining the actual pressure form the pressure sensed in the sensing step.

41. The method of claim 30 wherein:

said degree of the opening or closing is related to the degree of difference between the actual pressure and the theoretical pressure.

42. A method of inhibiting circulatory complications in a patient supported on an air bag support by changing the location at which pressure is exerted against the patient, comprising the steps of:

inflating a first and a second set of low air loss air bags to a baseline pressure to support a patient thereon, the second set of air bags being disposed alternately between the first set of air bags; and repetitively, and in opposite phase, increasing and decreasing the pressure within the first and second sets of air bags to predetermined maximum and minimum pressures above and below the baseline pressure, respectively, wherein the value of the minimum pressure is a percentage of the value of the baseline pressure, and the difference between the value of the baseline pressure and the value of the minimum pressure is twice the difference between the value of the maximum pressure and the value of the baseline pressure; and adjusting the baseline pressure in a manner which is in relation to the angular displacement of a first section relative to a second section of a frame supporting said patient supporting surface;

wherein said increasing and decreasing step further comprises:

sensing an actual pressure, the actual pressure being indicative of the pressure in at least one of said air bags;

determining the difference between a theoretical pressure an the actual pressure, the theoretical pressure being based on the baseline pressure and one of the maximum pressure and the minimum pressure; and opening or closing a valve to a degree to compensate for said difference.

43. An alternating pressure air support system for supporting a patient, comprising:

first and second sets of bags collectively forming a patient supporting surface, said air bags being transversely oriented relative to a longitudinal axis of said patient supporting surface and the second set of air bags being disposed alternately between the first set of air bags;

a source of pressurized gas;

first and second sets of manifolds in fluid communication with said pressurized gas source, the first set of manifolds being connected in fluid communication with the first set of air bags for conducting gas thereto for inflation thereof, and the second set of manifolds being connected in fluid communication with the second set of air bags for conducting gas thereto for inflation thereof;

first and second sets of variable valves associated with the first and second sets of manifolds for separately controlling the flow of gas through the first and second sets of manifolds, respectively; and a controller capable of operating in a first mode and a second mode, said controller being linked with said valves to control said valves in a manner such that pressures in the first and second set of air bags are maintained at preselected baseline pressure values when said controller is operating in the first mode and such that, when said controller is operating in the second mode, the pressures in the first and second sets of air bags are raised and lowered repetitively, and in opposite phase, above and below said preselected baseline pressure values.

* * * * *

UNITED STATES PATENT AND TRADEMARK OFFICE

CERTIFICATE OF CORRECTION

PATENT NO. : 5,044,029

DATED : September 3, 1991

INVENTOR(S) : John H. Vrzalik

It is certified that error appears in the above-identified patent and that said Letters Patent is hereby corrected as shown below:

Column 3, line 41, change "Pressure" to --pressure--
Column 4, line 3, change "Provided" to --provided--
Column 6, line 9, change "44' 40 40" to --44'''--
Column 9, line 23, change "lube 190" to --tube 190--
Column 10, line 55, change "78 and 78," to --78 and 78',--
Column 10, line 57, change "80 and 80" to --80 and 80'--
Column 10, line 58, change "78'" to --78 and 78'--
Column 10, line 66, change "78 and 78" to --78 and 78'--
Column 11, line 7, change "64 and 64" to --64 and 64'--
Column 18, line 19, change "Pressure" to --pressure--
Column 21, lines 44 and 45, change "44',44" and 44' 40' to --44', 44" and 44'''--.
Column 22, line 64, change "94" to --194--
Column 24, line 35, change "fame" to --frame--
Column 24, line 66, change "o" to --of--
Column 25, line 1, change "int eh" to --in the--
Column 26, line 33, change "change" to --changes--

Signed and Sealed this

Eighth Day of December, 1992

*Attest:*

DOUGLAS B. COMER

*Attesting Officer*

*Acting Commissioner of Patents and Trademarks*